US006917779B2

(12) United States Patent
Fujimori et al.

(10) Patent No.: US 6,917,779 B2
(45) Date of Patent: Jul. 12, 2005

(54) TONER CONVEYING DEVICE AND IMAGE FORMING APPARATUS INCLUDING THE TONER CONVEYING DEVICE

(75) Inventors: Kohta Fujimori, Yokohama (JP); Yoshio Hattori, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/452,046

(22) Filed: Jun. 3, 2003

(65) Prior Publication Data

US 2004/0009015 A1 Jan. 15, 2004

(30) Foreign Application Priority Data

Jun. 3, 2002 (JP) ..... 2002-161113
Sep. 20, 2002 (JP) ..... 2002-276021

(51) Int. Cl.[7] ..... G03G 15/08; G03G 15/10
(52) U.S. Cl. ..... 399/258; 399/61; 399/64
(58) Field of Search ..... 399/53, 58, 61, 399/64, 65, 258, 292; 222/DIG. 1

(56) References Cited

U.S. PATENT DOCUMENTS 3,727,065 A * 4/1973 Maksymiak ..... 399/65
4,369,733 A * 1/1983 Hirakura et al. ..... 399/64
5,530,529 A * 6/1996 Henderson et al. ..... 399/64
5,561,506 A * 10/1996 Kasahara ..... 222/DIG. 1
5,630,195 A 5/1997 Sawayama et al.
5,648,842 A 7/1997 Sekine et al.
5,761,570 A 6/1998 Sawayama et al.
5,860,038 A 1/1999 Kato et al.
6,055,386 A 4/2000 Kato et al.
6,125,257 A 9/2000 Sekine et al.
6,160,569 A 12/2000 Fujimori et al.
6,181,892 B1 1/2001 Fujimori
6,201,941 B1 * 3/2001 Kasahara et al. ..... 399/258
6,393,241 B1 * 5/2002 Matsumoto et al. ..... 399/258
6,496,677 B2 12/2002 Fujimori
6,501,913 B2 12/2002 Hattori et al.
6,507,720 B2 1/2003 Kabumoto et al.
6,560,438 B2 5/2003 Kosuge
6,567,637 B2 5/2003 Yanagisawa et al.
6,591,077 B2 7/2003 Yanagisawa et al.

FOREIGN PATENT DOCUMENTS

JP 5-204244 8/1993
JP 11-65252 3/1999
JP 2000-250298 9/2000

* cited by examiner

*Primary Examiner*—Sandra L. Brase
(74) *Attorney, Agent, or Firm*—Oblon, Spivak, McClelland, Maier & Neustadt, P.C.

(57) ABSTRACT

A toner conveying device includes a toner container that contains toner, a toner discharge urging device that urges the discharge of the toner from the toner container, a toner conveying mechanism that conveys the toner discharged from the toner container through a toner conveying path member, and a flow amount detecting device that detects the flow amount of the toner conveyed in the toner conveying path member.

23 Claims, 16 Drawing Sheets

| FIG. 9A |
| --- |
| FIG. 9B |

TONER CONVEYING DEVICE AND IMAGE FORMING APPARATUS INCLUDING THE TONER CONVEYING DEVICE

CROSS-REFERENCE TO RELATED APPLICATIONS

The present application claims priority to Japanese Patent Application No. 2002-161113 filed in the Japanese Patent Office on Jun. 3, 2002 and Japanese Patent Application No. 2002-276021 filed in the Japanese Patent Office on Sep. 20, 2002, the disclosures of which are hereby incorporated herein by reference.

BACKGROUND OF THE INVENTION

1. Field of the Invention

The present invention relates to a toner conveying device that conveys toner from a toner container to a developing device in an image forming apparatus such as a copying machine, a printer, a facsimile machine, or other similar image forming apparatus.

2. Discussion of the Background

An image forming apparatus such as a copying machine, a facsimile machine, a printer, or other similar image forming apparatus that forms images by use of a powder-shaped developer, such as toner, and a two-component developer including toner and magnetic carrier, has been widely used. In an electrophotographic image forming apparatus, a toner image is generally formed by developing an electrophotographic latent image formed on a latent image carrier with toner by a developing device. In the above-described image forming apparatus, it is necessary to supply toner to a developing device at an appropriate timing as image forming operations are repeated. To supply toner to a developing device, for example, an image forming apparatus includes a toner conveying device that urges the discharge of toner from a toner container, such as a toner bottle and a toner cartridge, by vibrating the toner container and that conveys the toner discharged from the toner container to a developing device through a toner conveying tube.

In the image forming apparatus including such a toner conveying device, an amount of toner supplied from a toner container to a developing device tends to be unstable depending on the condition of the toner in the toner container. Specifically, toner tends to be not easily discharged from the toner container due to the agglomeration of toner and the decrease of fluidity of toner caused by the moisture absorption of the toner. Therefore, the amount of toner supplied from a toner container to a developing device typically decreases in a relatively high humidity environment. When the amount of toner supplied from the toner container to the developing device becomes unstable, image quality deteriorates.

Further, in an image forming apparatus including a toner conveying device, when all the toner in the toner container is consumed, the toner container is replaced with a new one. If a large amount of toner remains in a used toner container when replacing the used toner container, the remaining toner is unnecessarily disposed of, thereby increasing the operating expense of the image forming apparatus, and harming the environment. For these reasons, it is desirable that the remaining amount of toner in the toner container should be monitored by a sensor, and the timing of replacement of the toner container should be adequately judged. However, if a sensor is provided in a disposable toner container, the cost of the toner container increases.

The above-described problems may occur not only in a toner conveying device in an image forming apparatus that conveys toner from a toner container to a developing device, but also in any types of powder conveying device that conveys powder from a powder container to a desired device.

Recently, electrophotographic image forming apparatuses have been downsized, and demands for a multi-color image forming apparatus have increased. Accordingly, each unit in an image forming apparatus needs to be downsized, and therefore the size of a developing device is decreased, so that toner needs to be frequently supplied from a toner container to the developing device.

When a toner end condition, in which the amount of the toner in a toner container is low or nearly nil, is not detected, a user finds the toner end condition just by seeing a deteriorated image. To avoid this problem, a detecting mechanism needs to be provided to detect the presence or absence of toner in a toner container.

For example, a background image forming apparatus includes a remaining toner amount detecting device, and a toner removing device that removes toner adhered to the remaining toner amount detecting device. When detecting the presence or absence of toner in a toner container by a remaining toner amount detecting device, the detection surface of the remaining toner amount detecting device needs to avoid forming a toner stain to avoid a detection error. Generally, the detection surface of a remaining toner amount detecting device is formed from a resin material in view of cost and process.

For example, one method of avoiding a detection error is a toner removing device that removes toner adhered to the detection surface of the remaining toner amount detecting device. In another method, a detection surface or a detecting device is provided to a toner container which is replaced after a relatively short period. In this case, even if toner is adhered to the detection surface, the detection surface is renewed by replacing the toner container.

However, in the former method, in addition to a toner removing device, a drive device that drives the toner removing device needs to be provided, thereby increasing the cost of the apparatus. Further, the location of the toner removing device is limited in an image forming apparatus. In the latter method, a detection error may be caused when a greater than expected amount of toner is adhered to the detection surface of the detecting device. Further, the latter method cannot be applied to a toner container which is replaced after a relatively long period.

Therefore, it is desirable to provide an image forming apparatus including a toner conveying device that can stabilize the amount of toner conveyed and can notify the user of the need for adequate replacement of a toner container. Further, the apparatus should be of simple construction and without increased expense. Further, it is desirable to provide an image forming apparatus including a toner conveying device having a detection device that can adequately detect the presence or absence of toner in a toner container over a long time period while preventing the adhesion of toner to the detection surface of the detection device without cleaning the detection surface of the detecting device.

SUMMARY OF THE INVENTION

According to one aspect of the present invention, a toner conveying device includes a toner container configured to contain toner, a toner discharge urging device configured to urge the discharge of the toner from the toner container, a toner conveying mechanism configured to convey the toner discharged from the toner container through a toner conveying path member, and a flow amount detecting device configured to detect the flow amount of the toner conveyed in the toner conveying path member.

According to another aspect of the present invention, an image forming apparatus includes a latent image carrier configured to carry a latent image, a developing device configured to develop the latent image with toner to form a toner image, and a toner conveying device that conveys toner to the developing device. The toner conveying device includes a toner container configured to contain toner, a toner discharge urging device configured to urge the discharge of the toner from the toner container, a toner conveying mechanism configured to convey the toner discharged from the toner container through a toner conveying path member, and a flow amount detecting device configured to detect the flow amount of the toner conveyed in the toner conveying path member. The image forming apparatus further includes a control device configured to control the toner discharge urging device to drive according to the detection result of the flow amount detecting device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
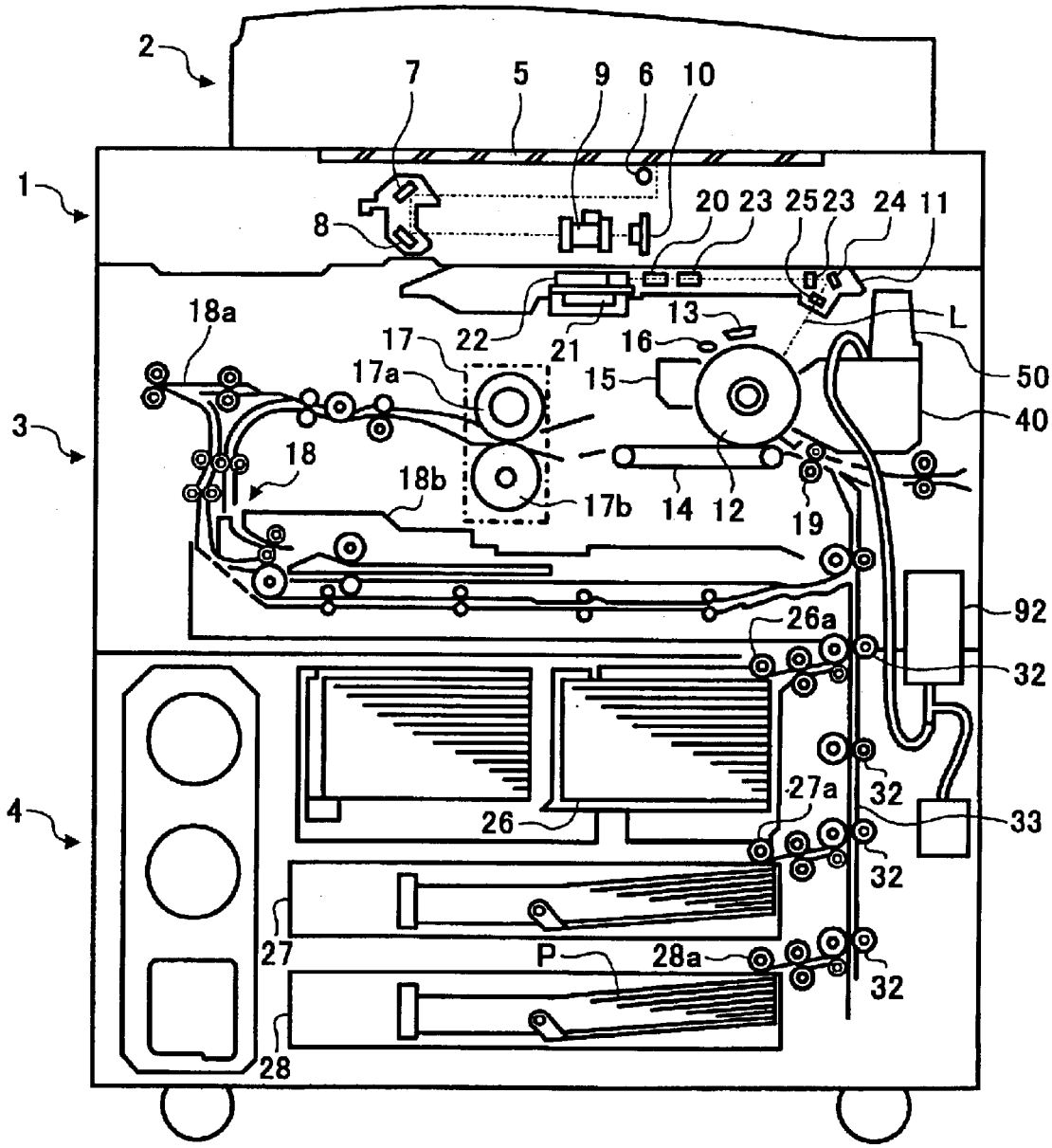
FIG. 1 is a schematic view of a construction of a main part of the copying machine according to the embodiment of the present invention.

Preferred embodiments of the present invention are described in detail referring to the drawings, wherein like reference numerals designate identical or corresponding parts throughout the several views. In the preferred embodiments, the present invention is applied to, for example, an electrophotographic copying machine (hereafter simply referred to as a "copying machine") as an image forming apparatus. The image forming apparatus of the present invention may be any type of image forming apparatus, for example, a copying machine, printer, facsimile machine, etc. or a multi-functional image forming apparatus, in which images including one or more colors are formed on a transfer material. First, a basic construction of the copying machine according to the present embodiment will be described.

FIG. 1 is a schematic view of a construction of a main part of the copying machine according to the embodiment of the present invention. As illustrated in FIG. 1, the copying machine includes an original document reading device 1, an auto document feeder 2, a printer device 3, and a sheet feeding device 4. The auto document feeder 2 automatically feeds an original document (not shown), which is set on the top surface of the auto document feeder 2, onto a contact glass 5 provided at the top surface of the original document reading device 1. The auto document feeder 2 is attached onto the original document reading device 1 such that the auto document feeder 2 covers and uncovers the contact glass 5.

The original document reading device 1 reads an image of an original document. Upon pressing a start switch (not shown) in the condition that an original document is manually set on the contact glass 5 by opening the auto document feeder 2, the original document reading device 1 starts to read the image of the original document. Alternatively, when the start switch is pressed in the condition that an original document is set on the auto document feeder 2, the original document reading device 1 starts to read the image of the original document after the original document is automatically fed onto the contact glass 5 by the auto document feeder 2.

Upon starting an image reading operation, a light source 6 that moves rightward in FIG. 1 irradiates an image surface of an original document set on the contact glass 5 with light. The light reflected from the image surface of the original document is reflected by a first mirror 7 and a second mirror 8. The light reflected from the second mirror 8 corresponding to the image of the original document is imaged on an image sensor 10 including a charge-coupled device through an imaging lens 9.

The printer device 3 is configured to form a toner image as an image on a transfer sheet (P), and includes a light writing unit 11, and a drum-shaped photoreceptor 12 serving as a latent image carrier (hereafter referred to as a "photoreceptor 12"). The printer device 3 further includes a charging device 13, a developing device 40, a transfer conveyance unit 14, a drum cleaning device 15, and a discharging device 16 around the photoreceptor 12. The printer device 3 further includes a fixing device 17, a reversing/discharging unit 18, and a pair of registration rollers 19. Upon pressing the start switch, the photoreceptor 12 starts to be rotated by a drive device (not shown).

The light writing unit 11 modulates a laser beam (L) and irradiates the photoreceptor 12 with the laser beam (L) in accordance with an image signal corresponding to an image read by the original document reading device 1. Specifically, a light source 20 including a laser diode emits the laser beam (L). The laser beam (L) emitted from the light source 20 is deflected so as to scan by a polygon mirror 22 rotated by being driven by a motor 21. The laser beam (L) is irradiated onto the photoreceptor 12 which has been uniformly charged by the charging device 13 via a lens system 23 including a fθ lens, a mirror 24, and a lens 25 so that an electrostatic latent image corresponding to an image of an original document is formed on the photoreceptor 12.

In the transfer conveyance unit 14, an endless transfer conveyance belt is spanned around a plurality of tension rollers and moves. A part of the transfer conveyance belt abuts against the circumferential surface of the photoreceptor 12, thereby forming a transfer nip part between the transfer conveyance belt and the photoreceptor 12. In the transfer nip part, a transfer bias roller (not shown) abuts against the rear surface (i.e., the inner circumferential surface) of the transfer conveyance belt. A light source (not shown) applies a transfer bias to the transfer bias roller, thereby forming a transfer electric field at the transfer nip part.

The developing device 40 develops an electrostatic latent image, which is formed on the photoreceptor 12 by the exposure of the light writing unit 11, with toner and forms a toner image. The toner image on the photoreceptor 12 moves to the transfer nip part. On the other hand, the pair of registration rollers 19 sandwich a transfer sheet (P) therebetween that is conveyed from the sheet feeding device 4 based on the operation of the start switch. The registration rollers 19 feed the transfer sheet (P) toward the transfer nip part at an appropriate timing so that the transfer sheet (P) is aligned with the toner image on the photoreceptor 12. Subsequently, the toner image is transferred from the surface of the photoreceptor 12 onto the surface of the transfer sheet (P) under the influence of the transfer electric field and the pressure produced in the transfer nip part. The transfer sheet (P) having passed through the transfer nip part is conveyed by the transfer conveyance belt in the transfer conveyance unit 14 to the fixing device 17. The fixing device 17 includes a heating roller 17*a* and a pressure roller 17*b* and sandwiches the transfer sheet (P) therebetween. The fixing device 17 fixes the toner image onto the transfer sheet (P) by the application of heat and pressure, and directs the transfer sheet (P) having a fixed toner image to the reversing/discharging unit 18.

The reversing/discharging unit 18 discharges the transfer sheet (P) to a sheet discharging tray (not shown) through a sheet discharging path 18*a*. When a dual-side copying mode is selected by a user, the transfer sheet (P) is reversed while passing through a reversing unit 18*b*, and is conveyed toward the pair of registration rollers 19. Subsequently, the transfer sheet (P) is fed from the registration rollers 19 toward the transfer nip part again. In the transfer nip part, a new toner image is transferred from the surface of the photoreceptor 12 to another side of the transfer sheet (P).

The drum cleaning device 15 removes a residual toner remaining on the surface of the photoreceptor 12 after a toner image is transferred from the photoreceptor 12 to the transfer sheet (P). The removed toner is collected in a toner accommodating tank (not shown). The surface of the photoreceptor 12 that has been subjected to the cleaning process is discharged by the discharging device 16. Subsequently, the charging device 13 uniformly charges the surface of the photoreceptor 12 to prepare for a next image forming operation.

The sheet feeding device 4 includes three sheet feeding cassettes 26, 27, 28, each of which stores a plurality of transfer sheets (P). The sheet feeding device 4 further includes a sheet feeding path 33 including a plurality of pairs of sheet feeding rollers 32. In the sheet feeding cassettes 26, 27, and 28, each of sheet feeding rollers 26*a*, 27*a*, 28*a* is pressed against a top sheet of the transfer sheets (P) stored in the sheet feeding cassettes 26, 27, and 28. With the rotation of the sheet feeding roller, a top sheet is fed out to the sheet feeding path 33. Upon pressing the start switch, a transfer sheet (P) is fed out from one of the sheet feeding cassettes 26, 27, and 28 to the sheet feeding path 33. The transfer sheet (P) is fed toward the registration rollers 19 by the plurality of pairs of the sheet feeding rollers 32 in the sheet feeding path 33.

A toner conveying device 50, which conveys and supplies powder-shaped toner to the developing device 40, is attached to the developing device 40 provided at the side of the photoreceptor 12. The developing device 40 accommodates a two-component developer (not shown) containing toner and magnetic carrier. The toner supplied into the developing device 40 by the toner conveying device 50 is mixed and agitated with the two-component developer accommodated in the developing device 40 for use in development.

A "T" sensor (not shown) is disposed at the bottom surface of the developing device 40. The "T" sensor outputs a signal corresponding to the permeability of the two-component developer in the developing device 40 to a control device (described below). Because the toner density of the two-component developer corresponds to the permeability, the "T" sensor also detects the toner density of the two-component developer. The control device controls the toner conveying device 50 to operate so that the value of output voltage of the "T" sensor approaches to a predetermined target output value of the "T" sensor, thereby increasing the toner density of the two-component developer which has been lowered in the developing process. Because the permeability of the two-component developer varies due to the change of environmental conditions such as humidity and the change of the bulk of the two-component developer, the control device corrects the target output value of the "T" sensor appropriately. Specifically, the control device corrects the target output value of the "T" sensor according to the image density of a reference toner image formed on the photoreceptor 12 at a predetermined timing. For example, the image density of a reference toner image is determined based on an output of a reference toner image density sensor constructed with a reflection-type photosensor that detects a light reflectivity of a reference toner image.

Figure 2:
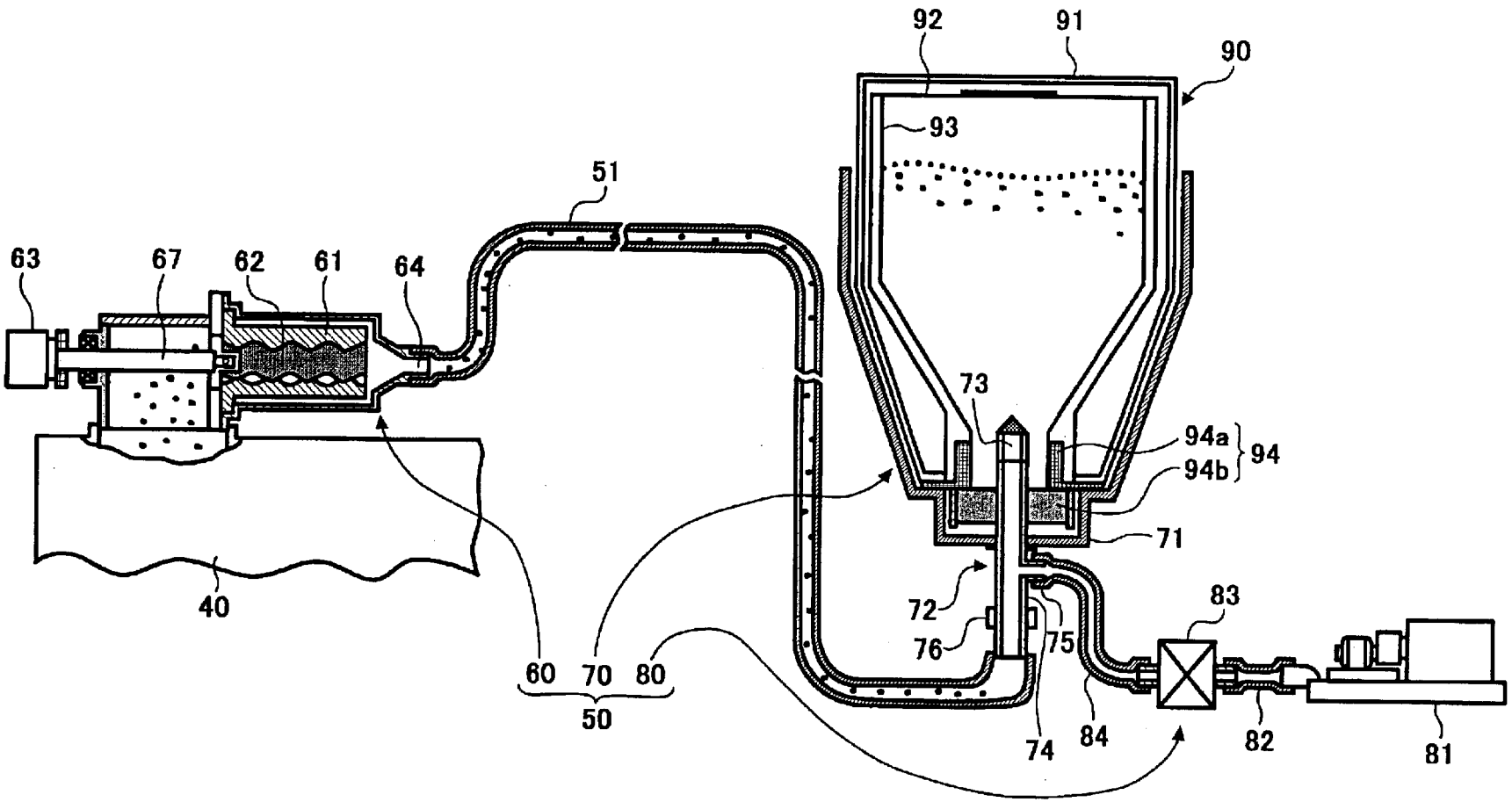
FIG. 2 is a schematic view of a construction of a toner conveying device in the copying machine of FIG. 1.

Next, a characteristic construction of the copying machine according to the embodiment of the present invention will be described. FIG. 2 is a schematic view of a construction of the toner conveying device 50. The toner conveying device 50 includes a suction pump 60, a cartridge holder 70, and an air pump section 80. The suction pump 60 is a uniaxial eccentric screw pump (so-called Moineau-pump). In the suction pump 60, a negative pressure is produced in a suction opening 64 by rotating a rotor 62 disposed in a stator 61 by a motor 63. The tip portion of a flexible suction tube 51 is connected to the suction opening 64.

The cartridge holder 70 includes a holder section 71 and a nozzle 72 inserted into the bottom surface of the holder section 71. The holder section 71 is configured to hold a toner cartridge 90 functioning as a toner container. The toner cartridge 90 includes a protection case 91 formed from a material, such as a paper having rigidity, a cardboard, or plastic, and a toner accommodating bag 92.

The toner accommodating bag 92 includes a bag portion 93 in a shape of a bag formed from a single-layer or multiple-layer sheet member having a thickness in a range of about 80 $\mu$m to about 200 $\mu$m, and a mouthpiece portion 94 fixed on the toner discharging side of the bag portion 93. The toner accommodating bag 92 is kept in an airtight condition. Examples of the sheet member include a resin sheet made of polyethylene and nylon, and a paper sheet. The toner accommodating bag 92 accommodates a fresh toner for replenishment therein. The mouthpiece portion 94 of the toner accommodating bag 92 includes an engagement portion 94*b* made of a rigid material, such as, resin or paper to be fitted into the opening of the bag portion 93, and an opening seal portion 94*a* made of an elastic material such as sponge.

The toner cartridge 90 is attached to the holder section 71 of the cartridge holder 70 such that the mouthpiece portion 94 is directed downward. In this condition, the leading edge of the nozzle 72 that is inserted into the bottom surface of the holder section 71 enters the bag portion 93 through the opening seal portion 94*a* of the mouthpiece portion 94 of the toner accommodating bag 92. The opening seal portion 94*a* is brought into intimate contact with the periphery of the nozzle 72, thereby preventing the leakage of toner from the toner cartridge 90. A toner suction opening 73 is formed on the leading edge side of the nozzle 72. Further, a T-junction is formed on the trailing edge side of the nozzle 72 so that a toner passage 74 and an air receiving path 75 separate from each other. The trailing edge of the suction tube 51 is connected to the toner passage 74.

The air pump section 80 includes an air pump 81, a relay tube 82, an electromagnetic valve 83 connected to the relay tube 82, and an air tube 84. The air pump 81 supplies air into the air receiving path 75 of the nozzle 72 through the relay tube 82, the electromagnetic valve 83, and the air tube 84 under the condition that the electromagnetic valve 83 is opened. When the suction pump 60 is in non-operation, the suction pump 60 is configured not to receive fluid through the suction opening 64. With this construction, the air, which is sent from the air pump 81 into the air receiving path 75 of the nozzle 72, flows into the bag portion 93 through the toner suction opening 73 of the nozzle 72, without flowing into the toner passage 74. The air agitates the toner in the bag portion 93, thereby preventing the occurrence of a so-called toner blocking phenomenon in the bag portion 93. In the toner blocking phenomenon, the discharge of toner is blocked due to agglutinate toner.

Even if the toner blocking phenomenon occurs when the toner is left in the bag portion 93 for a relatively long time, the airflow breaks agglutinate toner. As a result, the toner in the bag portion 93 is urged to be discharged from the toner cartridge 90 while the toner smoothly flows toward the toner suction opening 73 of the nozzle 72 by its own weight. As described above, the air pump section 80 functions as a toner discharge urging device by supplying air to the toner cartridge 90.

In the air pump section 80, a movable member such as an agitation paddle that urges the discharge of toner need not be provided in the toner cartridge 90 that is detached from the cartridge holder 70 when all the toner in the toner cartridge 90 is consumed. Therefore, as compared to a toner cartridge including an agitation paddle functioning as a toner discharge urging device, the cost of the toner cartridge 90 can be reduced in this embodiment.

Alternatively, a shaking device as a toner discharge urging device that shakes the toner cartridge 90 may be provided to urge the discharge of toner from the toner cartridge 90 by vibrations. However, when using such a shaking device, vibrations may be given to the main body of the copying machine. As a result, the deterioration of image quality and fatigue of members caused by vibrations may occur. In the air pump section 80, the vibrations given to the main body of the copying machine are greatly reduced as compared to the shaking device. Therefore, a bad influence due to vibrations can be largely restrained.

Figure 3:
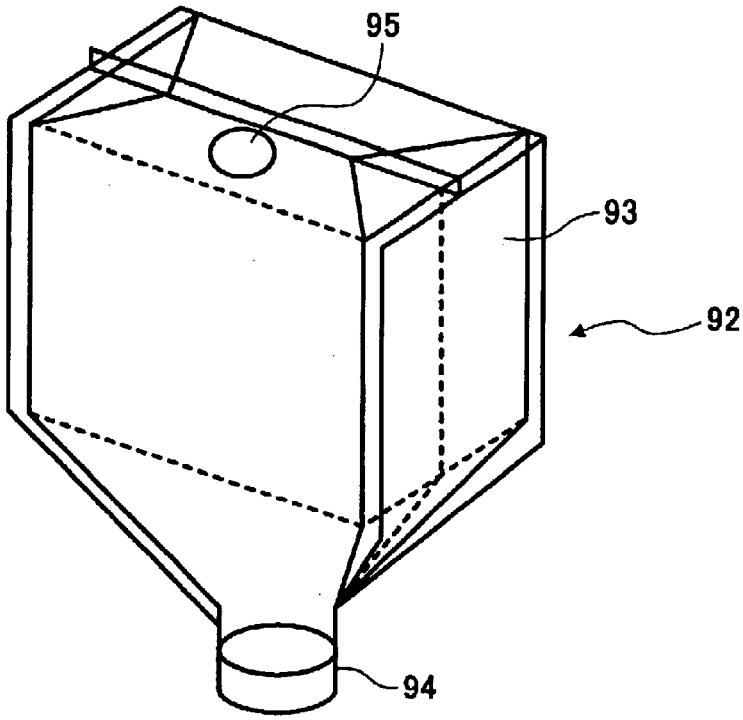
FIG. 3 is a perspective view of a toner accommodating bag of a toner cartridge in the toner conveying device of FIG. 2.

FIG. 3 is a perspective view of the toner accommodating bag 92. As illustrated in FIG. 3, an airflow filter 95 is provided in the bottom part of the bag portion 93 of the toner accommodating bag 92, that is, on the side opposite from the toner discharging side. The air flowing into the bag portion 93 from the air pump 81 is discharged from the bag portion 93 through the airflow filter 95. The airflow filter 95 has fine meshes so as not to pass toner particles.

Referring back to FIG. 2, when the electromagnetic valve 83 in the air pump section 80 is closed, a space from the bag portion 93 in the toner cartridge 90 to the suction pump 60 through the nozzle 72 and the suction tube 51 is made in an airtight condition. When a negative pressure is produced in the suction tube 51 by actuating the suction pump 60, a sucking force is produced in the toner suction opening 73 of the nozzle 72. As a result, the toner in the bag portion 93 is sucked through the toner suction opening 73, and passes through the toner passage 74 of the nozzle 72, the suction tube 51, and the suction pump 60. Subsequently, the toner is supplied into the developing device 40 connected to the toner discharging side of the suction pump 60.

The suction tube 51 is connected between the suction pump 60 and the nozzle 72, and is formed from rubber materials and plastic materials which are superior in flexibility and toner resistant property such that the suction tube 51 has an inner diameter of about 3 mm to about 7 mm. Examples of the rubber materials include polyurethane rubber, nitrile rubber, EPDM rubber, silicone rubber, and other similar rubber. Examples of the plastic materials include polyethylene, nylon, and other similar plastic. A toner conveying path can be arranged freely in the copying machine by use of the flexible suction tube 51, and thereby the copying machine can be designed with numerous layouts.

In the toner conveying device 50, even if the toner cartridge 90 is located at a position lower than the developing device 40 in the gravitational direction, toner can be smoothly pumped up and supplied to the developing device 40 by use of the suction pump 60 having a relatively high suction power. This allows the copying machine to be designed with numerous layouts, and the toner cartridge 90 can be disposed at a position where a user can easily replace the toner cartridge 90 with a new one.

Figure 4:
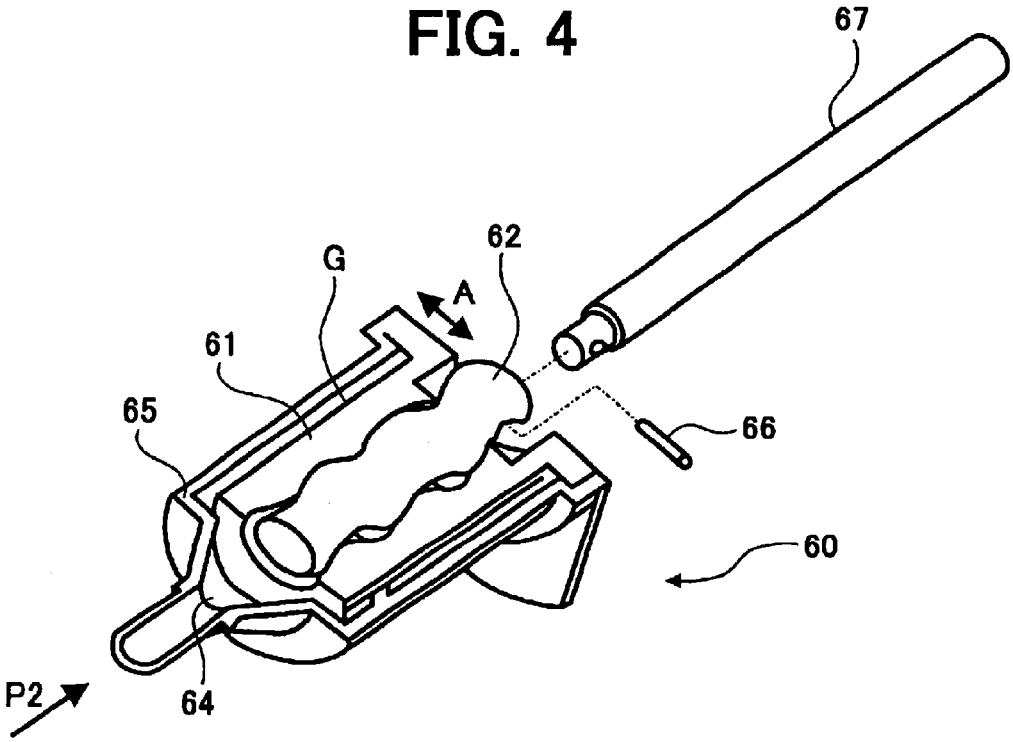
FIG. 4 is a perspective exploded view of a pump section of a suction pump in the toner conveying device of FIG. 2.

FIG. 4 is a perspective exploded view of a pump section of the suction pump 60. As illustrated in FIG. 4, the pump section of the suction pump 60 includes the stator 61, the rotor 62, and a holder 65 that holds the stator 61. The stator 61 is formed from an elastic member such as rubber, and is formed into a shape of a female screw. On the internal circumference surface of the stator 61 is formed a spiral groove having two stripes. The rotor 62 is formed from materials such as metal and resin, and is formed into a shape of a male screw. The rotor 62 is rotatably disposed in the spiral groove of the stator 61.

A drive shaft 67 is connected and fixed to the trailing edge of the rotor 62 by a spring pin 66. The holder 65 holds the stator 61 such that the stator 61 can swing in the direction indicated by an arrow (A) by bringing a flange portion provided at the end portion of the stator 61 into contact with the inner circumference surface of the holder 65. A gap (G) is formed between the inner surface of the holder 65 and the outer surface of the stator 61 for the swinging motion of the stator 61.

A motor (not shown) is connected to the tip portion of the drive shaft 67, and the rotor 62 is rotated in the stator 61 by rotating the drive shaft 67. At this time, the rotor 62 eccentrically rotates due to its shape. When the rotor 62 eccentrically rotates, the stator 61 swings in the direction indicated by the arrow (A). When the rotor 62 rotates, a closed space formed in the stator 61 moves from one side of the suction opening 64 to the other side of the drive shaft 67, thereby generating a suction force (P2) of about 10 kPa to about 20 kPa in the suction opening 64. As a result, toner is sucked into the suction pump 60 from the suction opening 64. Subsequently, the sucked toner passes through the inside of the pump section of the suction pump 60, and is discharged from the suction pump 60 through a toner discharging outlet (not shown) provided below the drive shaft 67. A correlation between the number of rotation of the rotor 62 and the amount of toner conveyed and supplied from the toner cartridge 90 can be held so long as toner is stably discharged from the bag portion 93 toward the nozzle 72. However, if the toner is not stably discharged from the bag portion 93, air instead of toner is sucked into the pump section of the suction pump 60 even though the rotor 62 rotates, thereby reducing toner conveyance efficiency.

As described above, in the toner conveying device 50 in the copying machine according to the present embodiment, the toner in the toner cartridge 90 is conveyed to the developing device 40 by the suction of the suction pump 60. In the above-described construction of the toner conveying device 50, a movable member such as a screw-shaped auger need not be provided in a toner conveying tube to convey the toner from the toner cartridge 90 to the developing device 40. Therefore, the construction of the toner conveying device 50 can be simplified, thereby reducing the cost of the copying machine. Further, in the present embodiment, the deformable suction tube 51 is employed as a toner conveying tube, and can be arranged freely in the main body of the copying machine. When toner is conveyed by a movable member such as an auger provided in a toner conveying tube, the toner conveying tube needs to be arranged in a linear condition. As a result, a copying machine needs to be designed with limited layouts.

It is known that the amount of toner sucked and conveyed by the suction pump 60 is in proportion to the rotation amount of the rotor 62. Therefore, basically, the amount of toner supplied to the developing device 40 can be accurately controlled by controlling the rotation amount of the rotor 62. If toner is left in the bag portion 93, the bulk density of the toner gradually increases. As a result, the amount of toner per unit volume increases, so that the amount of toner sucked and conveyed by the suction pump 60 is not accurately in proportion to the rotation amount of the rotor 62. However, in the toner conveying device 50 in the copying machine according to the present embodiment, the increase of the bulk density of toner can be restrained by regularly supplying air into the toner cartridge 90 from the air pump 81. Therefore, an unstable amount of toner supplied to the developing device 40 due to the increase of the bulk density of the toner in the toner cartridge 90 can be prevented.

Figure 5:
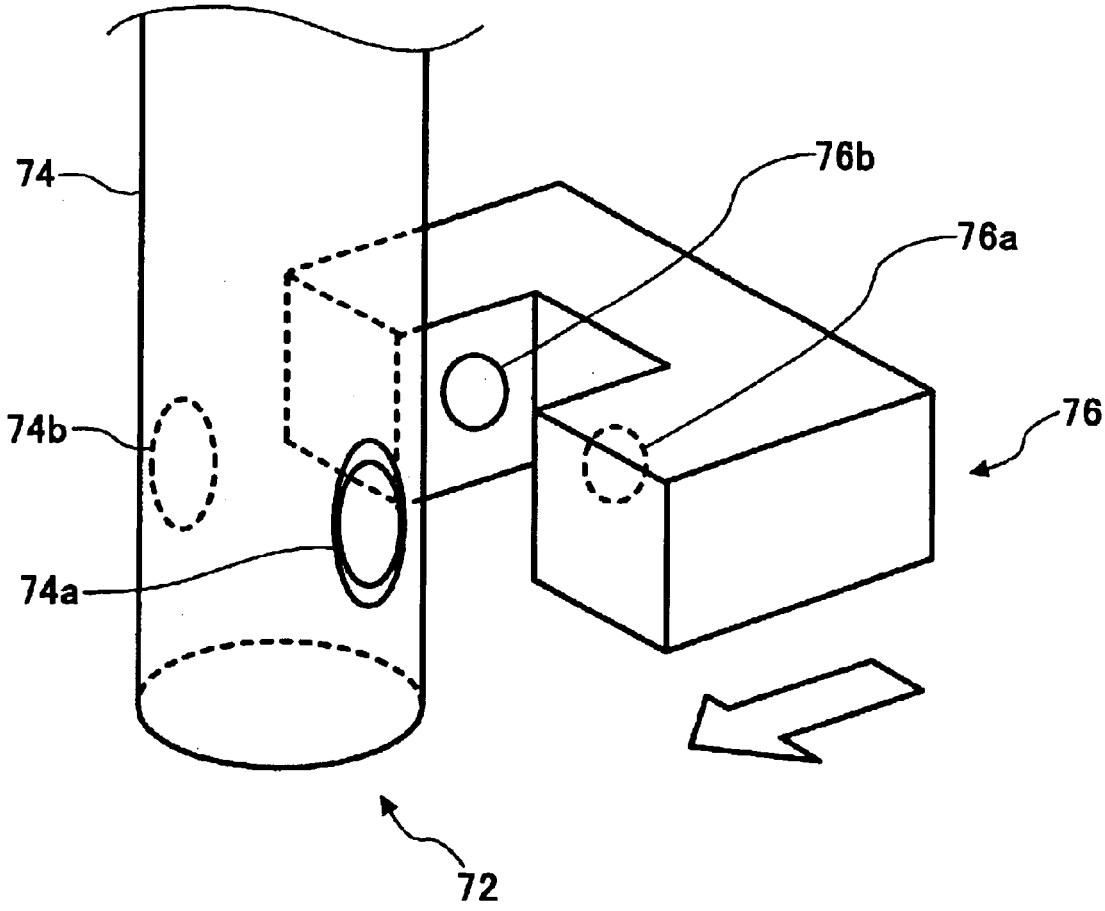
FIG. 5 is a perspective view of a part of a toner passage of a nozzle, and a toner flow sensor in the toner conveying device of FIG. 2.

FIG. 5 is a perspective view of a part of the toner passage 74 of the nozzle 72, and a toner flow sensor 76. Referring to FIG. 5, the toner passage 74 of the nozzle 72 is formed from a colored resin material such as black color acrylonitrile-butadiene-styrene (ABS). Further, the toner passage 74 includes two transparent windows 74*a* and 74*b* opposite to each other via a toner flow path in the toner passage 74. The transparent windows 74*a* and 74*b* are covered by the toner flow sensor 76 functioning as a flow amount detecting device. The toner flow sensor 76 is formed from a transmission photosensor as an optical sensor, and includes a light-emitting element 76*a* and a light-receiving element 76*b*. The light emitted from the light-emitting element 76*a* passes through the transparent window 74*a*, the toner flow path in the toner passage 74, and the transparent window 74*b*, and is received by the light-receiving element 76*b*. The light-receiving element 76*b* generates a photo-electric current corresponding to the amount of the received light.

Figure 6:
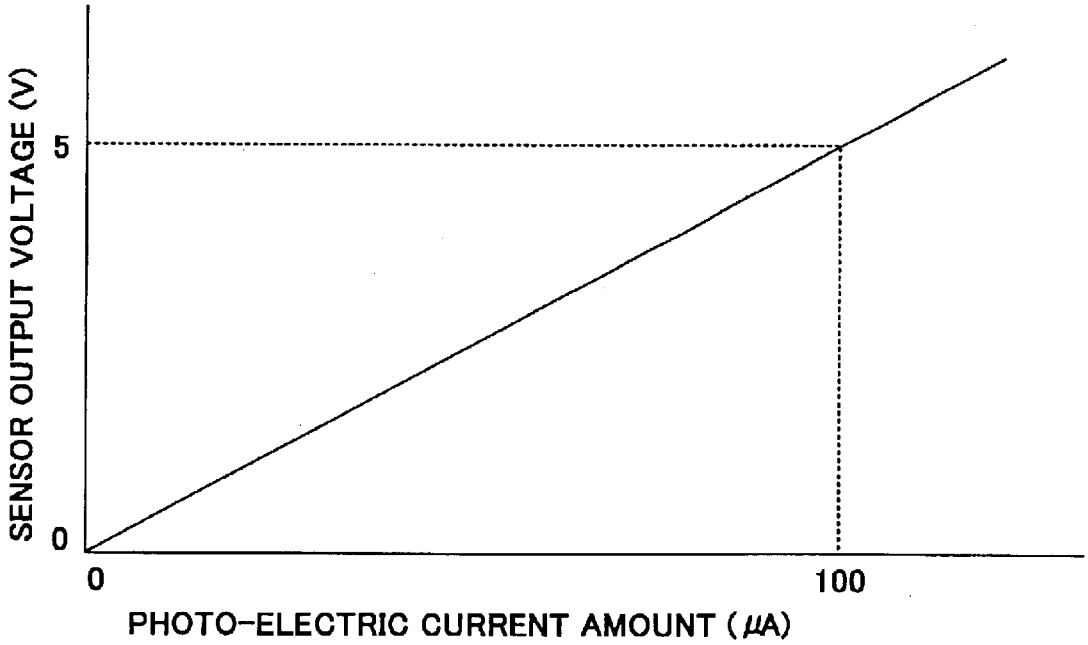
FIG. 6 is a graph showing a relationship between an output voltage of the toner flow sensor and an amount of photo-electric current generated from a light-receiving element.
Figure 7:
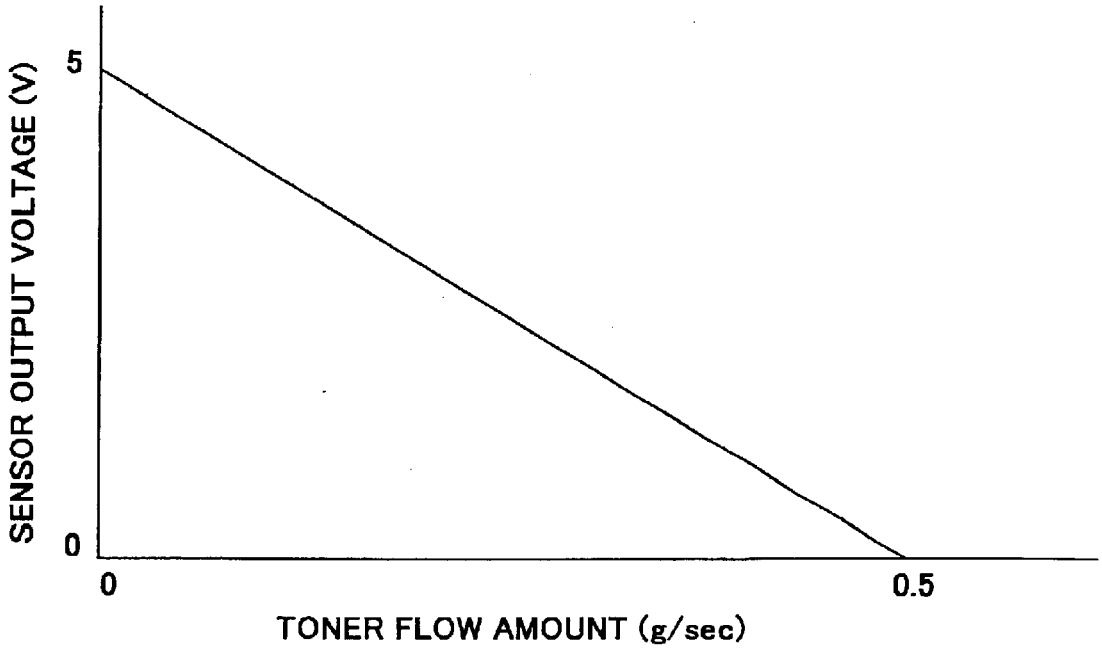
FIG. 7 is a graph showing a relationship between an output voltage of the toner flow sensor and an amount of toner flowing in the toner passage.

FIG. 6 is a graph showing a relationship between an output voltage of the toner flow sensor 76 and an amount of photo-electric current generated from the light-receiving element 76*b*. As illustrated in FIG. 6, as the amount of photo-electric current increases while the amount of light received by the light-receiving element 76*b* increases, the value of output voltage of the toner flow sensor 76 increases. Referring back to FIG. 5, as the amount of toner flowing in the toner passage 74 of the nozzle 72 increases, the amount of light received by the light-receiving element 76*b* decreases. Accordingly, as the output voltage of the toner flow sensor 76 increases, the amount of toner flowing in the toner passage 74 decreases as illustrated in the graph of FIG. 7. The value of output voltage of the toner flow sensor 76 corresponds to the amount of toner flowing in the toner passage 74 functioning as a toner conveying tube. As compared to a detector which detects the amount of toner flowing in a toner conveying tube based on the rotation amount of a rotation member driven to rotate by the movement of toner in the toner conveying tube, the amount of toner flowing in the toner conveying tube can be detected with a simple construction by use of the toner flow sensor 76.

In the present embodiment, the toner passage 74 of the nozzle 72 includes two transparent windows 74*a* and 74*b* as illustrated in FIG. 5. However, the nozzle 72 may be formed from a transparent material without providing the transparent windows 74*a* and 74*b*. Further, in the present embodiment, the amount of toner flowing in the toner passage 74 of the nozzle 72 is detected by the toner flow sensor 76. Alternatively, the amount of toner flowing in the suction tube 51 may be detected by the toner flow sensor 76. Moreover, if one transparent window is provided in the toner passage 74, and if the inner wall of the nozzle 72 has a mirror-finished surface, and if the light incident from the transparent window is reflected by the mirror-finished surface of the inner wall of the nozzle 72, a reflection-type photosensor can be employed. Similarly as the transmission-type photosensor, the amount of toner flowing in the toner conveying tube can be detected with a simple construction by use of the reflection-type photosensor. In the present embodiment, a phototransistor is used as the light-receiving element 76*b*. Instead of the phototransistor, a digital photo-interrupter may be used.

As described above, in the copying machine according to the present embodiment, the toner in the toner cartridge 90 is conveyed to the developing device 40 by the suction of the suction pump 60. Therefore, a movable member need not be provided in the toner conveying tube such as the suction tube 51 and the nozzle 72. When the amount of toner flowing in the toner conveying tube is detected by an optical sensor such as a transmission type photosensor, and if a movable member is provided in the toner conveying tube, the amount of toner flowing in the toner conveying tube needs to be detected while avoiding the movable member. In this case, to secure a space for detecting the toner flow amount, the diameter of the toner conveying tube may need to be increased more than necessary. Further, the toner conveying tube may tend to be clogged up with toner in a partial space where the movable member is not located. In the copying machine according to the present embodiment, the toner in the toner cartridge 90 is conveyed to the developing device 40 without using a movable member. Therefore, the above-described problems caused by the movable member can be obviated.

Figure 8:
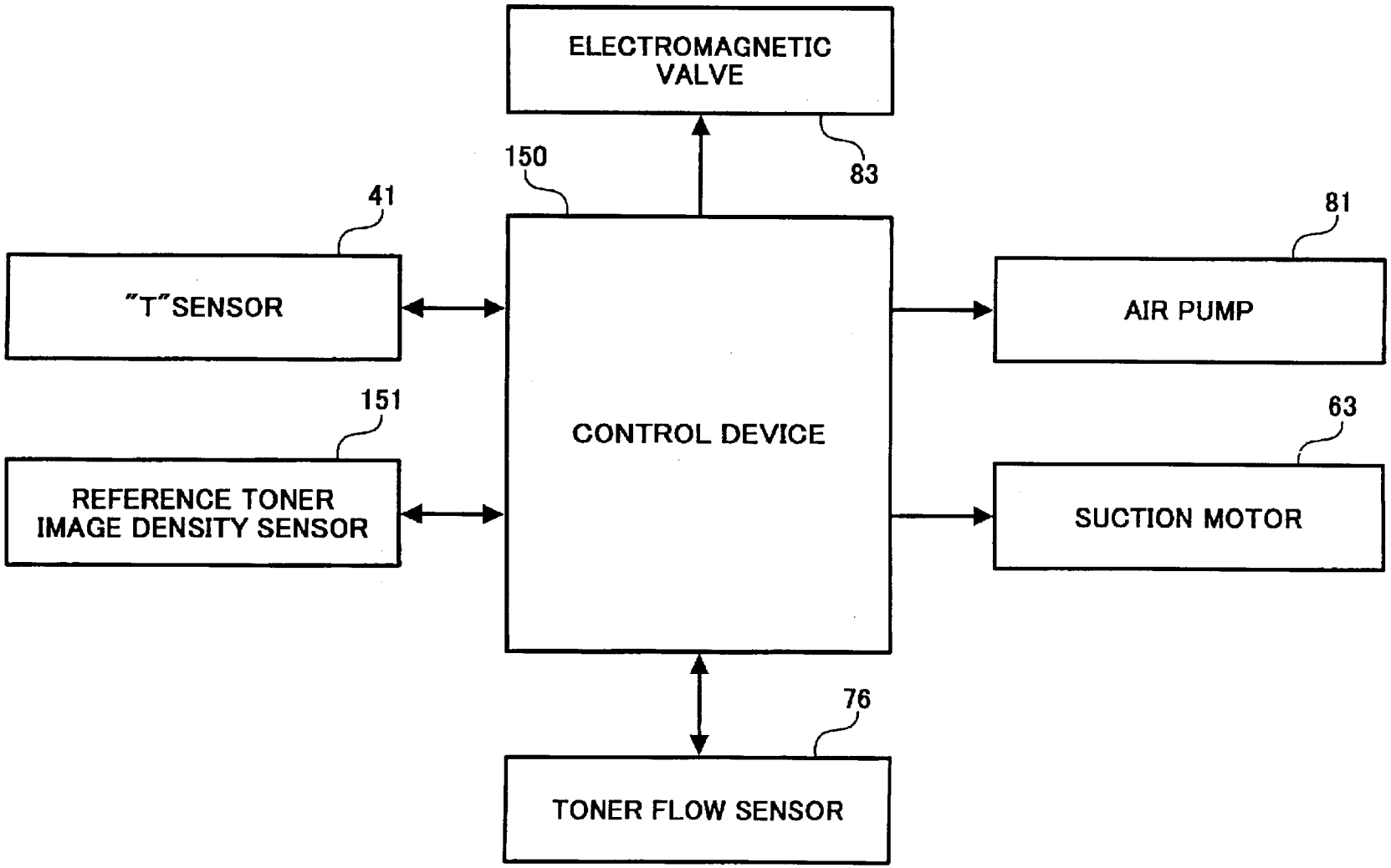
FIG. 8 is a block diagram illustrating a part of an electric circuit in the copying machine according to the present embodiment.

FIG. 8 is a block diagram illustrating a part of an electric circuit in the copying machine according to the present embodiment. Referring to FIG. 8, a control device 150 constructed with a micro processing unit (hereafter referred to as a "MPU") controls the operations of the main body of the copying machine including the toner conveying device 50. A reference toner image density sensor 151 and a "T" sensor 41 are connected to the control device 150. The reference toner image density sensor 151 detects the density of a reference toner image formed on the photoreceptor 12. The "T" sensor 41 detects the density of toner in a two-component developer in the developing device 40. Further, the suction motor 63, the air pump 81, and the electromagnetic valve 83 provided in the toner conveying device 50 are connected to the control device 150. Moreover, the toner flow sensor 76 is connected to the control device 150.

The output value of the reference toner image density sensor 151 is used for the correction of the above-described target output value of the "T" sensor 41. The control device 150 determines the operation time (i.e., the drive amount) of the suction motor 63 for supplying toner to the developing device 40 based on a comparison result between the value of output voltage of the "T" sensor 41 and the target output value of the "T" sensor 41. Specifically, an operation time "Ta" of the suction motor 63 required for supplying toner to the developing device 40 to adjust the density of toner in the two-component developer in the developing device 40 is obtained by the following calculation:

$$Ta=(A-B)\times K1 \quad (1)$$

where "A" is a target output value of the "T" sensor 41, "B" is a value of output voltage of the "T" sensor 41, and "K1" is a coefficient.

In the calculation (1), the coefficient "K1" is used to convert the difference between the target output value of the "T" sensor 41 and the value of output voltage of the "T" sensor 41 to the operation time "Ta" of the suction motor 63 required for supplying an amount of toner corresponding to the difference to the developing device 40. When the density of toner in the two-component developer in the developing device 40 exceeds the density of the reference toner image, the operation time "Ta" of the suction motor 63 results in a negative value.

Next, the control device 150 calculates an operation time "Tb" of the suction motor 63 required for supply an amount of toner corresponding to an amount of toner to be consumed by printouts to the developing device 40 from the following calculation:

$$Tb=C\times K2 \quad (2)$$

where "C" is an image area in a printout, and "K2" is a coefficient.

In the calculation (2), the coefficient "K2" is used to convert a consumption amount of toner corresponding to an image area in a printout to the operation time "Tb" of the suction motor 63 required for supplying an amount of toner corresponding to the consumption amount of toner to the developing device 40. The control device 150 combines the calculated operation time "Ta" and "Tb" of the suction motor 63 and obtains as a total operation time of the suction motor 63 required for supplying toner to the developing device 40, and controls the suction motor 63 to drive for the obtained operation time.

The control device 150 has a timer function, and accumulates the operation time of the suction motor 63 for supplying toner to the developing device 40 (hereafter simply referred to as a "toner supply operation time"). Further, the control device 150 controls the air pump 81 to drive at a predetermined timing, thereby controlling the toner in the toner cartridge 90 to be agitated by the air flowing into the toner cartridge 90 from the air pump 81. The control device 150 is configured to be supplied with electric power even when the main power switch (not shown) of the copying machine is turned off. Therefore, a cumulative count value of the toner supply operation time stored in the control device 150 is maintained.

Reasons for accumulatively counting the toner supply operation time are as follows. As described referring to FIG. 3, the air flowed into the bag portion 93 of the toner accommodating bag 92 from the air pump 81 is discharged from the bag portion 93 through the airflow filter 95. Because the airflow filter 95 has fine meshes so as not to pass toner particles, it takes some time to discharge air from the bag portion 93. Immediately after the operation of the air pump 81, the air pressure in the bag portion 93 temporarily increases. If the air pump 81 operates too much, the air pressure in the bag portion 93 excessively increases, and thereby the occurrences of toner clogging and toner blocking may be accelerated.

Therefore, in the copying machine of the present embodiment, every time the amount of toner discharged from the bag portion 93 reaches a predetermined value, the air pump 81 is intermittently actuated for a predetermined time, and thereby the excessive increase of air pressure in the bag portion 93 is obviated. The toner supply operation time is accumulatively counted for determining if the amount of toner discharged from the bag portion 93 reaches a predetermined value or not. The balance between the toner discharging amount and air supplying time depends on the size of meshes of the air filter 95 and the air supplying pressure of the air pump 81. In view of the stability of the toner agitation and the increasing inner pressure in the bag portion 93, it is preferable to supply air into the bag portion 93 for one second to supply the toner for one second.

When toner is sucked by the suction pump 60 while the air pump 81 is actuated, a short circuit occurs in an air flow path between the air receiving path 75 and the toner passage 74 in the nozzle 72. This short circuit not only causes inadequate air flow into the bag portion 93, but also causes decreased toner conveyance efficiency due to the air suction. Therefore, when toner is supplied from the toner cartridge 90 to the developing device 40 by the suction pump 60, the electromagnetic valve 83 is closed, and the air pump 81 is deactivated.

Figures 9, 9A:
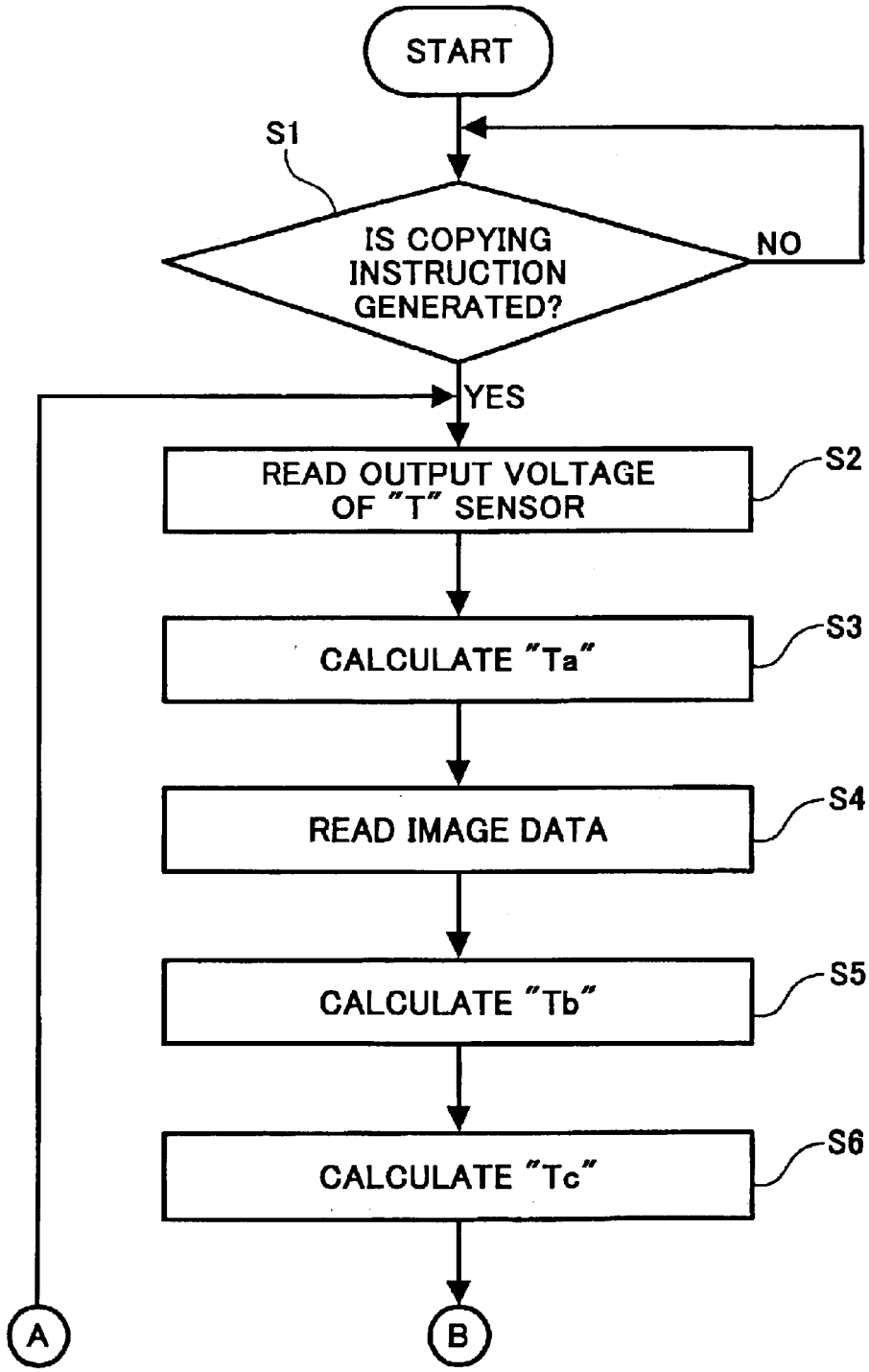
FIGS. 9A and 9B are flowcharts of toner supply control operation steps of a control device in the copying machine.
Figure 9B:
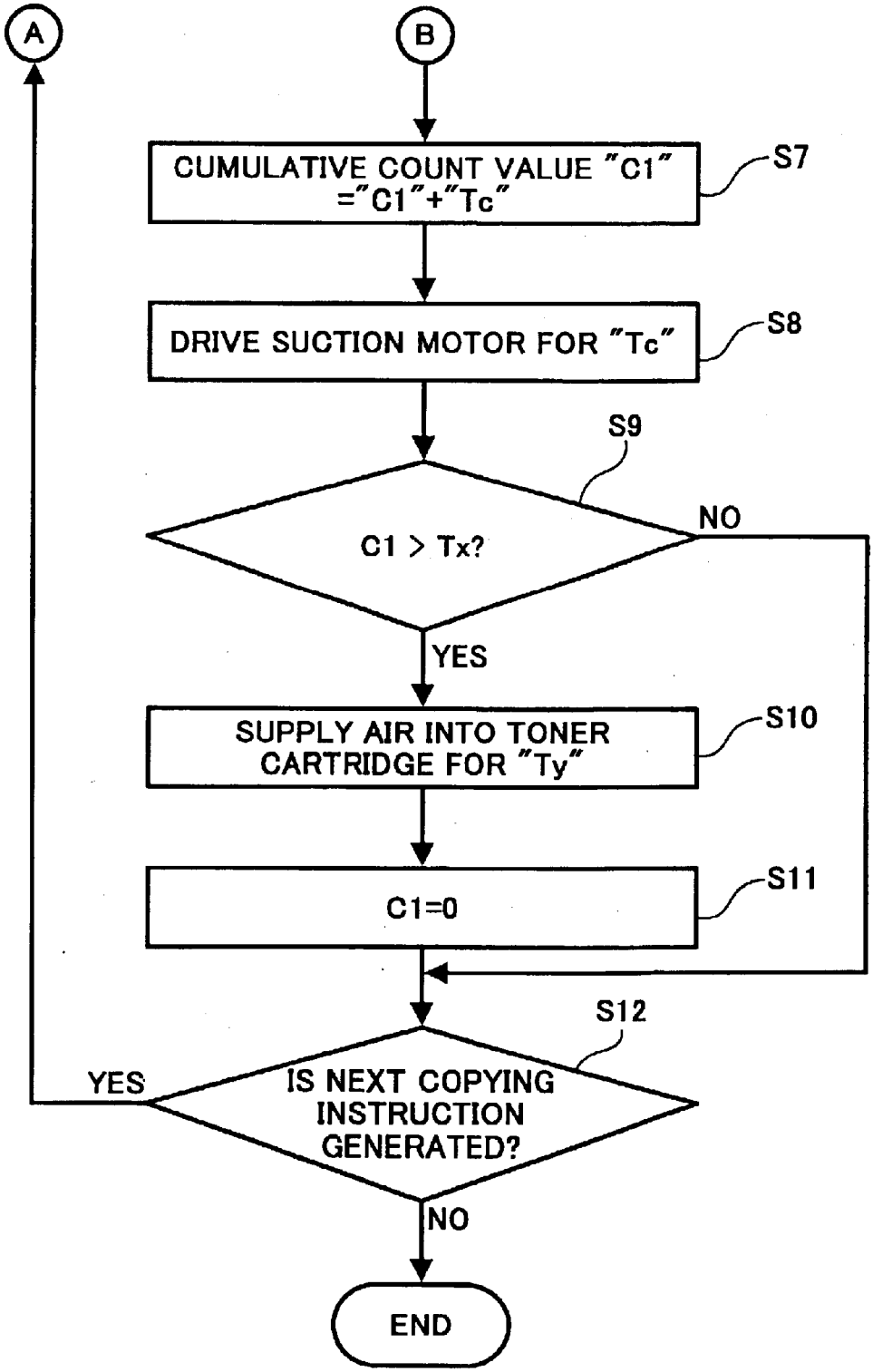

FIGS. 9A and 9B are flowcharts of toner supply control operation steps of the control device 150. In the toner supply control operation, the control device 150 determines if the copying instruction is generated or not in step S1. If the answer is YES in step S1, the control device 150 reads the value of output voltage of the "T" sensor 41 in step S2. If the answer is NO in step S1, the toner supply control operation returns to reexecute step S1. Subsequently, in step S3, the control device 150 calculates the operation time "Ta" of the suction motor 63 required for supplying toner to the developing device 40 based on the read value of output voltage of the "T" sensor 41 from the above-described calculation (1).

Next, the control device 150 reads image data to be printed out in step S4, and calculates an image area in a printout and further calculates the operation time "Tb" of the suction motor 63 required for supplying an amount of toner corresponding to an amount of toner to be consumed by printouts to the developing device 40 based on the calculated image area in a printout from the above-described calculation (2) in step S5. In step S6, the control device 150 calculates a total operation time "Tc" required for supplying toner to the developing device 40 by combining the calculated operation time "Ta" and "Tb" of the suction motor 63. Subsequently, in step S7, the control device 150 adds the calculated operation time "Tc" to a cumulative count value "C1" of the toner supply operation time.

Next, in step S8, the control device 150 causes the suction motor 63 to drive for the operation time "Tc" to supply toner to the developing device 40, and then determines if the cumulative count value "C1" exceeds a reference operation time "Tx" from the start of toner supply operation in step S9. If the answer is YES in step S9, a next air supply by the air pump 81 is needed because a predetermined amount of toner has been supplied to the developing device 40 after the completion of the previous air supply. In this case, the air pump 81 is caused to supply air into the toner cartridge 90 for a predetermined time "Ty" in step S10. Then, the cumulative count value "C1" is reset to zero in step S11. Subsequently, the control device 150 determines if a next copying instruction is generated or not in step S12.

If the cumulative count value "C1" is less than or equal to the reference operation time "Tx" (NO in step S9), a next air supply by the air pump 81 is not yet needed. In this case, the control device 150 determines if a next copying instruction is generated or not in step S12 without supplying air into the toner cartridge 90 from the air pump 81. If a next copying instruction is generated (YES in step S12), the toner supply control operation returns to reexecute step S2. If a next copying instruction is not generated (NO in step S12), the toner supply control operation ends. It is preferable that the developing roller in the developing device 40 should be rotated during the above-described toner supply control operation. With regard to the timing of starting the toner supply control operation, it is preferable to start the toner supply control operation when a start signal for writing an electrostatic latent image onto the photoreceptor 12 is generated.

Figure 10:
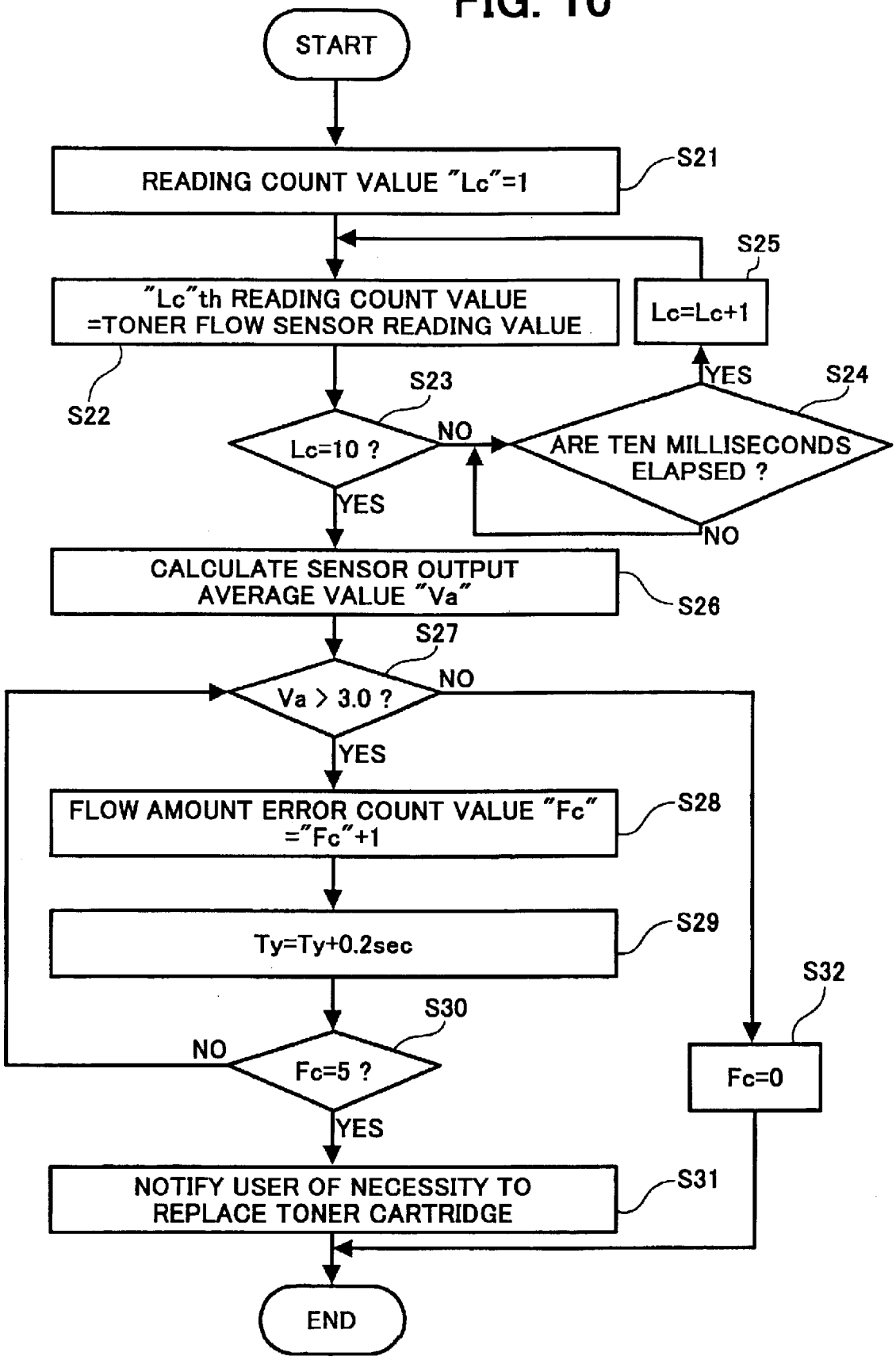
FIG. 10 is a flowchart of airflow amount adjusting control operation steps of the control device in the copying machine.

FIG. 10 is a flowchart of airflow amount adjusting control operation steps of the control device 150. In step S21, the control device 150 sets a reading count value "Lc" as one. Next, in step S22, the control device 150 reads the value of output voltage of the toner flow sensor 76 as the "Lc" the reading count value (i.e., as the first reading count value). Subsequently, the control device 150 determines if the reading count value "Lc" equals 10 or not in step S23. If the answer is NO in step 23, the control device 150 determines if ten milliseconds are elapsed after the control device 150 reads the first value of output voltage of the toner flow sensor 76 or not in step S24. If the answer is NO in step S24, the airflow amount adjusting control operation returns to reexecute step S24. If the answer is YES in step S24, the control device 150 changes the reading count value "Lc" by adding one in step S25 (i.e., "Lc" then becomes two). Subsequently, the control device 150 reads the value of output voltage of the toner flow sensor 76 as the second reading count value, and repeats the airflow amount adjusting control operation steps S22 through S25 until the reading count value "Lc" equals 10 in step S23.

If the reading count value "Lc" equals 10 in step S23, the control device 150 calculates an average value "Va" of ten values of the output voltage of the toner flow sensor 76 in step S26. Then, the control device 150 determines if the average value "Va" exceeds 3.0V or not in step S27. If the average value "Va" is less than or equal to 3.0V (NO in step S27), the amount of toner flowing in the toner passage 74 is adequate. Therefore, a flow amount error count value "Fc" (described below) is reset to zero in step S32, and the airflow amount adjusting control operation ends.

If the average value "Va" exceeds 3.0V (YES in step S27), the amount of toner flowing in the toner passage 74 is significantly reduced to result in an insufficient flow amount condition. This insufficient flow amount condition is caused by one of the following two reasons: (1) toner in the toner cartridge 90 is almost consumed (hereafter referred to as a "toner end condition"), and (2) toner is not adequately discharged from the toner cartridge 90. If the control device 150 determines the insufficient flow amount condition in step S27, the control device 150 adds one to a flow amount error count value "Fc" in step S28. Subsequently, the control device 150 adds 0.2 seconds to a predetermined time "Ty" in step S29. As described in step S10 in FIG. 9B, the time "Ty" means a drive time per one operation of the air pump 81 for supplying air into the toner cartridge 90. Therefore, if the average value "Va" exceeds 3.0V, and the amount of toner flowing in the toner passage 74 is significantly reduced, the drive time "Ty" per one operation of the air pump 81 is extended by 0.2 seconds. Thereby, the discharge of toner from the toner cartridge 90 is accelerated while preventing the excessive air supply from the air pump 81. When the insufficient flow amount condition occurs because toner is not adequately discharged from the toner cartridge 90, for example, due to the toner blocking, the amount of toner flowing in the toner passage 74 increases due to the accelerated discharge of toner from the toner cartridge 90.

However, when the insufficient flow amount condition occurs because the toner in the toner cartridge 90 is almost consumed, the amount of toner flowing in the toner passage 74 does not increase even if the discharge of toner from the toner cartridge 90 is accelerated. In this case, after step S29, the control device 150 determines if the flow amount error count value "Fe" equals 5 or not in step S30. As described above, if the average value "Va" is determined to not exceed 3.0V even one time, the flow amount error count value "Fc" is reset to zero in step S32. When the flow amount error count value "Fc" equals 5 in step S30, this means that insufficient flow amount conditions are successively detected five times. In this case, the insufficient flow amount condition is caused by the toner end condition. Specifically, the control device 150 determines the remaining amount of toner (mainly, toner end condition) in the toner cartridge 90 based on the detection result of the toner flow sensor 76 and the frequency of occurrence of the insufficient flow amount condition. Therefore, when the flow amount error count value "Fc" equals 5 in step S30, the control device 150 causes the notification of the user of the necessity for replacing the toner cartridge 90 with a new one by a display unit (not show) or a beeper in step S31, and the airflow amount adjusting control operation ends. When the flow amount error count value "Fc" does not equal 5 in step S30, the airflow amount adjusting control operation returns to reexecute step S27. As a standard for determining the remaining amount of toner in the toner cartridge 90, the drive time "Ty" per one operation of the air pump 81 may be used instead of the flow amount error count value "Fc".

In the copying machine according to the present embodiment, the toner flow sensor 76 that detects the amount of toner flowing in the toner passage 74 is also used to detect the remaining amount of toner in the toner cartridge 90. With this construction, the user can be adequately notified of the need for replacement of the toner cartridge while achieving the cost reduction of the copying machine.

An alternative method of determining an adequate drive time of the air pump 81 and an adequate replacement timing of the toner cartridge 90 can be employed. Specifically, the recovery of the density of toner in the two-component developer is judged based on the operation time "Tc" required for supplying toner to the developing device 40 and based on the output of the "T" sensor 41 or the reference toner image density sensor 151. If the density of toner in the two-component developer is judged to be difficult to recover, the drive time of the air pump 81 is extended or the necessity of the replacement of the toner cartridge 90 is notified. However, in the above-described alternative method, because the recovery of the toner density is judged from an actual low toner density condition, the deterioration of image quality due to the low toner density may occur.

Alternatively, the drive time of the air pump 80 may be extended or the necessity of the replacement of the toner cartridge 90 may be notified based on the prospect of the toner consumption amount that is obtained by counting the cumulative image area of output images. However, in this method, an error typically occurs between the count value of the cumulative image area and an actual toner consumption amount. As a result, the deterioration of image quality due to the excess and deficiency of the toner supply amount may occur. Further, the necessity of the replacement of a toner cartridge may be notified even though sufficient toner remains in the toner cartridge.

The present inventors carried out experiments in which images are continuously output by use of the copying machine of the present embodiment under the following conditions: (1) the toner flow sensor 76 uses a digital photo-interrupter that outputs voltage of 0V (no light receipt) through 5.5V (saturation of the amount of light received) according to the amount of light received by the light-receiving element 76*b*; (2) in step S27 of the flowchart of airflow amount adjusting control operation steps of the control device 150 in FIG. 10, the control device 150 determines if the average value "Va" is less than or equal to 3.0V instead of if the average value "Va" exceeds 3.0V or not; and (3) in the flowchart of airflow amount adjusting control operation steps of the control device 150 in FIG. 10, the control device 150 samples the output voltage of the "T" sensor 41 for 2 seconds every 50 milliseconds, and calculates an average value "Va" of twenty values of the output voltage of the "T" sensor 41.

Figure 11:
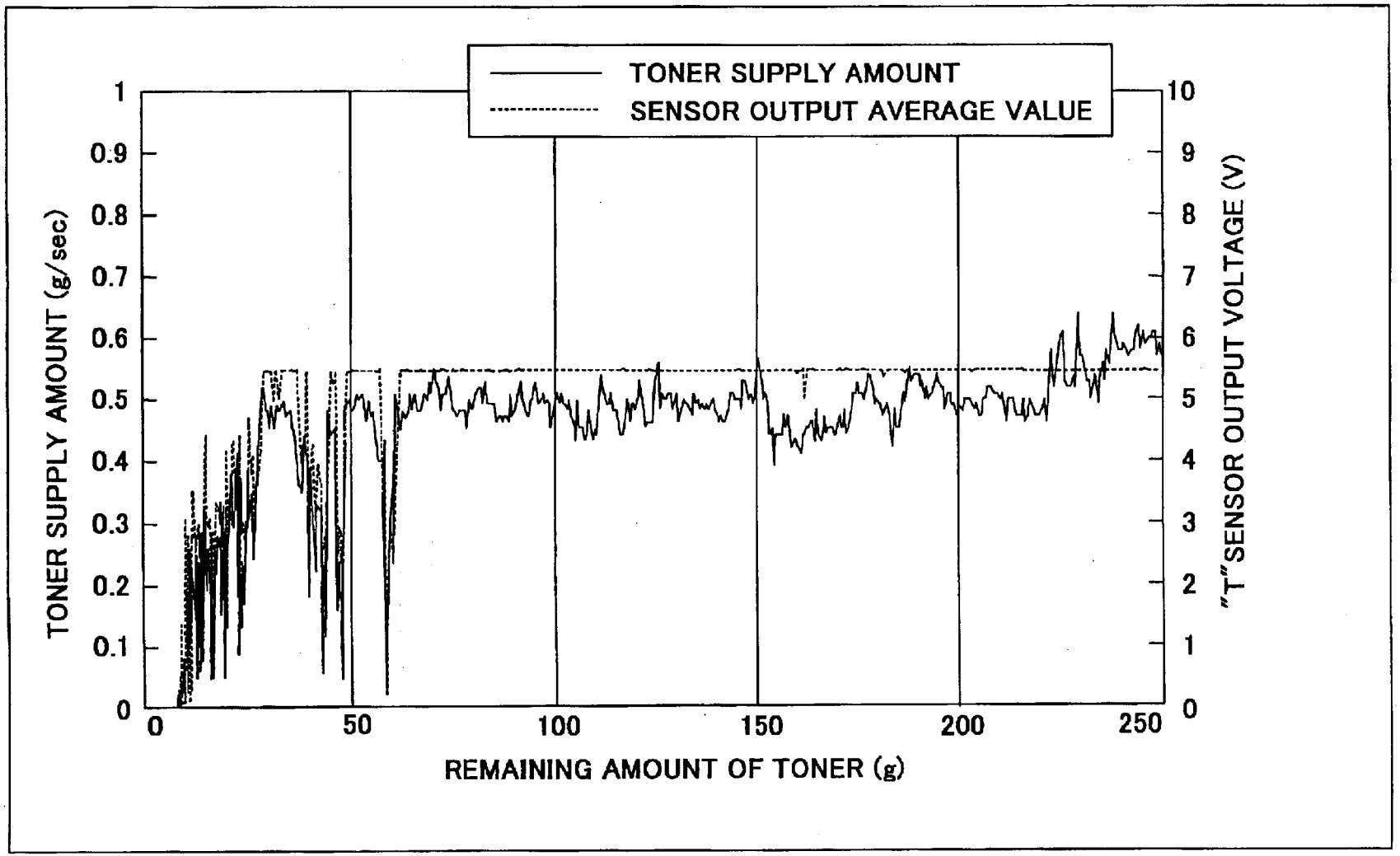
FIG. 11 is a graph showing a relationship between the remaining amount of toner in the toner cartridge, a toner supply amount, and an output voltage of a "T" sensor based on experimental results.

FIG. 11 is a graph showing a relationship between the remaining amount of toner in the toner cartridge 90, a toner supply amount, and an output voltage (average value "Va") of the "T" sensor 41 based on experimental results. As seen from FIG. 11, in the period of time during which the remaining amount of toner in the toner cartridge 90 decreases from an initial value of 250 g to about 65 g, the value of output voltage of the "T" sensor 41 does not fall below 3.0V, and the toner flowing amount is stable. However, when the remaining amount of toner in the toner cartridge 90 falls below 65 g, the value of output voltage of the "T" sensor 41 sometimes falls below 3.0V. As a result, the drive time of the air pump 81 "Ty" is extended in the airflow amount adjusting control operation of the control device 150.

Figure 12:
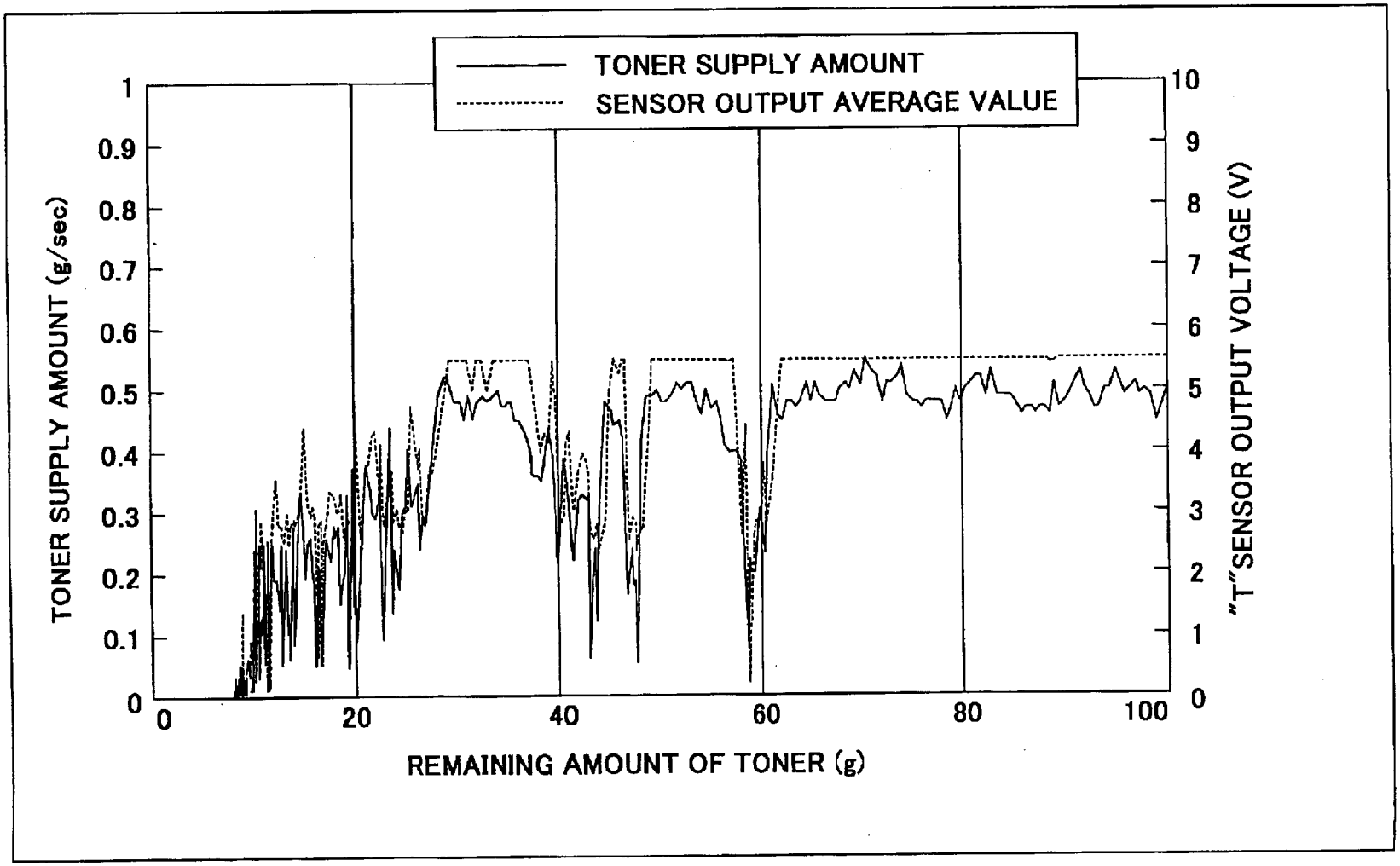
FIG. 12 is a graph showing a relationship between the remaining amount of toner in the toner cartridge in the range of 0 to 100 g, a toner supply amount, and an output voltage of the "T" sensor based on experimental results.

FIG. 12 is a graph showing a relationship between the remaining amount of toner in the toner cartridge 90 in the range of 0 to 100 g, a toner supply amount, and an output voltage (average value "Va") of the "T" sensor 41 based on experimental results. As seen from FIG. 12, when the remaining amount of toner in the toner cartridge 90 is in the range of 30 g to 65 g, even if the value of output voltage of the "T" sensor 41 sometimes falls below 3.0V, the output voltage of the "T" sensor 41 recovers soon by extending the drive time of the air pump 81 "Ty". This is because the discharge of toner from the toner cartridge 90 is accelerated by extending the drive time of the air pump 81 "Ty", and thereby the flow amount of toner recovers.

However, when the remaining amount of toner in the toner cartridge 90 falls below 30 g, the value of output voltage of the "T" sensor 41 frequently falls below 3.0V. This is because even if the drive time of the air pump 81 "Ty" is extended, the toner flow amount does not recover easily. When the remaining amount of toner in the toner cartridge 90 decreases to about 10 g, the above-described insufficient flow amount condition is continuously detected five times, and then the necessity of the replacement of toner cartridge is notified. If the remaining amount of toner in the toner cartridge 90 is about 10 g, and even if the toner cartridge 90 containing such a small remaining amount of toner is replaced with a new one, it does not affect the running cost. When forming images under the condition that the remaining amount of toner in the toner cartridge 90 is less than about 10 g, the toner supply amount becomes insufficient, resulting in an inferior image such as a low density image. From the experimental results, it was found that in the copying machine according to the embodiment of the present invention, an adequate timing of replacement of the toner cartridge can be notified while stabilizing the toner supply amount.

In the copying machine according to the above-described embodiment, the airflow amount adjusting control operation is performed by controlling the air pump 81 based on the detection result of the flow amount sensor 76. In the airflow amount adjusting control operation, the discharge of toner from the toner cartridge 90 is accelerated by extending the drive time of the air pump 81 "Ty", and thereby the flow amount of toner recovers quickly. With the quick recovery of the flow amount of toner, the amount of toner supplied to the developing device 40 can be stabilized, and thereby a good quality image can be obtained. Further, in the airflow amount adjusting control operation, the adequate replacement timing of the toner cartridge 90 can be notified with a simple construction, so that an image quality can be maintained.

Figure 13:
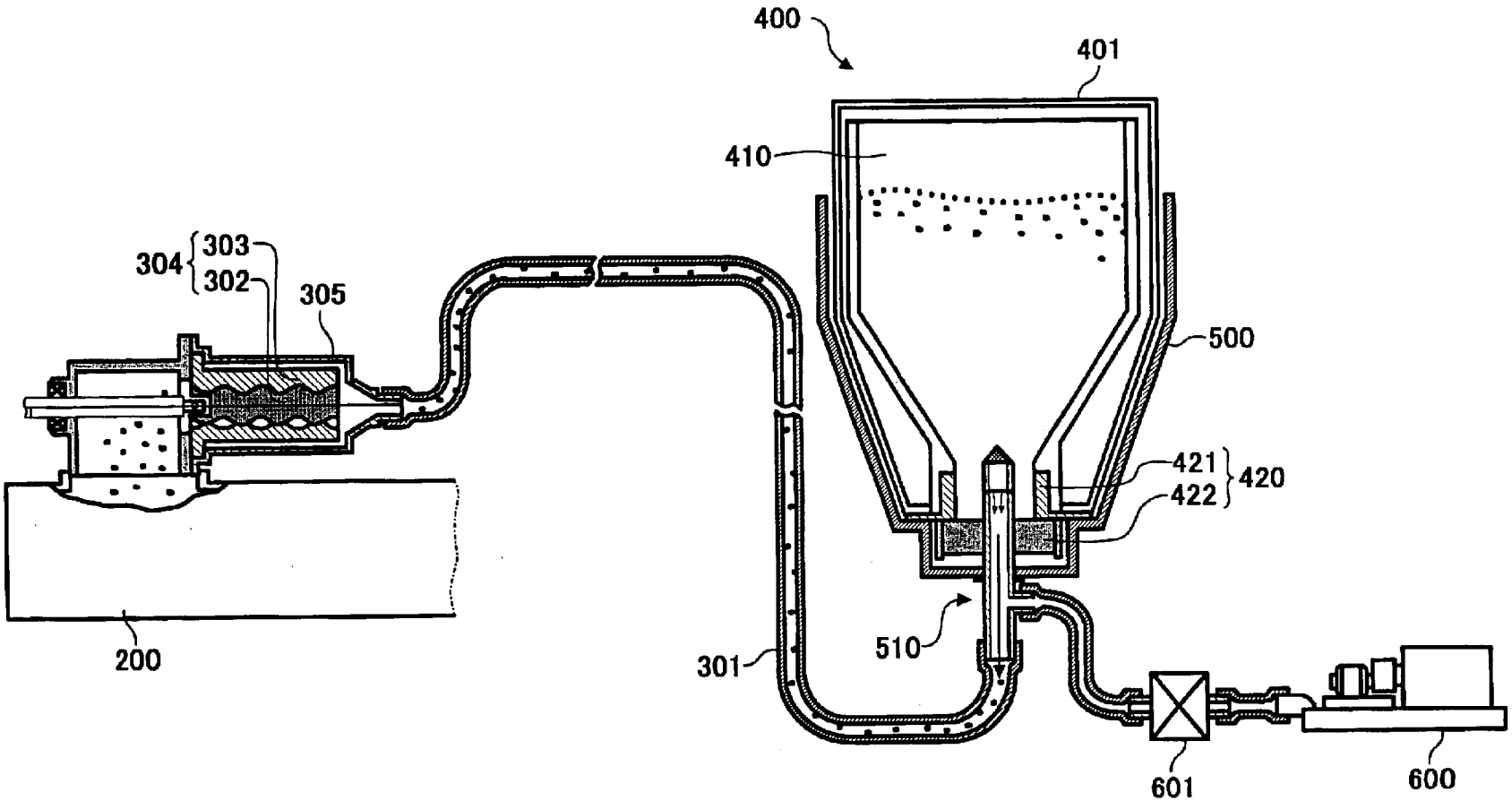
FIG. 13 is a schematic view of a construction of a toner conveying device according to another embodiment of the present invention.

Hereafter, another embodiment of the present invention will be described. FIG. 13 is a schematic view of a construction of a toner conveying device according to another embodiment of the present invention.

Referring to FIG. 13, a powder pump 304 is attached to a developing device 200 to supply toner to the developing device 200. The powder pump 304 uses, for example, a suction type uniaxial eccentric screw pump (so-called Moineau pump). As illustrated in FIG. 13, the powder pump 304 includes a rotor 302, a stator 303, and a holder 305. The rotor 302 is formed from a material having rigidity such as metal, and is formed into a shape of an eccentric waviness screw. The stator 303 is formed from an elastic material such as rubber, and surrounds the rotor 302. On the internal circumference surface of the stator 303 is formed a spiral groove having two stripes. The holder 305 holds the stator 303 and is formed from resin materials. The powder pump 304 is configured to suck toner from a toner container 400 through a flexible tube 301 by a strong self-priming force (a suction pressure) generated in the powder pump 304 by rotating the rotor 302.

As described above, the toner contained in the toner container 400 is discharged therefrom by the suction force of the powder pump 304 and also by the own weight of toner as seen from FIG. 13. Generally, the fluidity of toner for use in an electrophotographic process is low. Therefore, if the toner is supplied to the developing device 200 only by use of the powder pump 304, a so-called toner bridge phenomenon may occur in the toner container 400 after the toner in the vicinity of a nozzle 510 that is attached to the lower portion of the toner container 400 is sucked. In the toner bridge phenomenon, only a portion of toner positioned above a discharge outlet is discharged, and a void is formed around a position where toner is discharged from the discharge outlet of a toner container. As a result, toner is not conveyed smoothly from the toner container 400 to the developing device 200, and thereby an amount of toner supplied to the developing device 200 becomes unstable, and a relatively large amount of toner is left in the toner container 400.

Figure 14:
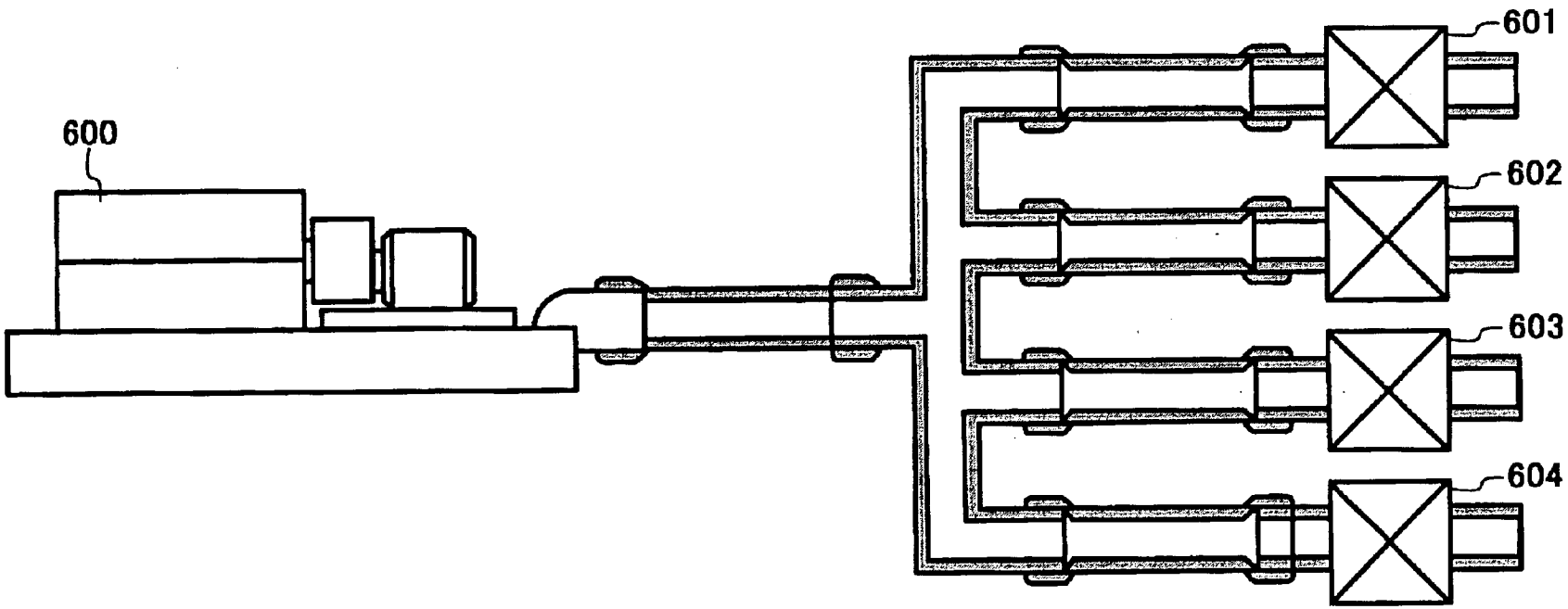
FIG. 14 is a schematic view of an air supply device in the toner conveying device of FIG. 13 that supplies air such that air is divided into electromagnetic valves for respective colors.

To avoid this problem, an air supply device 600 is attached to the toner container 400, in addition to the powder pump 304. The air supply device 600 supplies air into the toner container 400 through an electromagnetic valve 601 and the nozzle 510. In a multi-color image forming apparatus, as illustrated in FIG. 14, the air supply device 600 supplies air such that air is divided into electromagnetic valves 601 through 604 for respective colors. The actual time for supplying air to the toner container 400 is preferably at most 5 seconds or less in view of the clog due to excessive air. Even in a multi-color image forming apparatus (e.g., four colors), air can be supplied from the single air supply device 600. The air supply device 600 is a conventional air pump, and supplies air at a flow rate of about 1 through 3 liters per minute.

The tube 301 is connected between the powder pump 304 and the toner container 400, and is formed from rubber materials and plastic materials which are superior in flexibility and toner resistant property such that the tube 301 has an inner diameter of about 4 mm to about 10 mm. Examples of the rubber materials include polyurethane rubber, nitrile rubber, EPDM rubber, silicone rubber, and other similar rubber. Examples of the plastic materials include polyethylene, nylon, and other similar plastic.

A container holder 500 holds a protection case 401 of the toner container 400 and is made of resin. The protection case 401 is made of materials such as paper having rigidity, cardboard, and plastic, and surrounds a flexible toner accommodating bag 410. A part of the protection case 401 is engaged with a base member 420 for discharging toner. Because the protection case 401 has rigidity, the operability for attaching/detaching the toner container 400 to/from the container holder 500 is enhanced, that is, when the toner container 400 is replaced with a new one. Further, the toner in the toner container 400 is protected from environmental conditions by the protection case 401, and thereby the quality of toner in the toner container 400 can be maintained.

The toner accommodating bag 410 is formed from resin materials such as polyethylene and nylon or flexible sheet materials having a thickness of about 80 $\mu$m to about 200 $\mu$m. The toner accommodating bag 410 has a single or multiple layer construction, and is kept in an airtight condition.

The base member 420 for discharging toner includes a case 421 and a seal member 422. The case 421 is formed from resin materials such as polyethylene and nylon. If the case 421 is formed from the same material as the toner accommodating bag 410, it is advantageous for recycling, and the case 421 is easily adhered to the toner accommodating bag 410. Alternatively, it is possible to use a flexible toner container in which a base portion formed by a blow molding method and a toner accommodating portion are integrally constructed.

Figure 15:
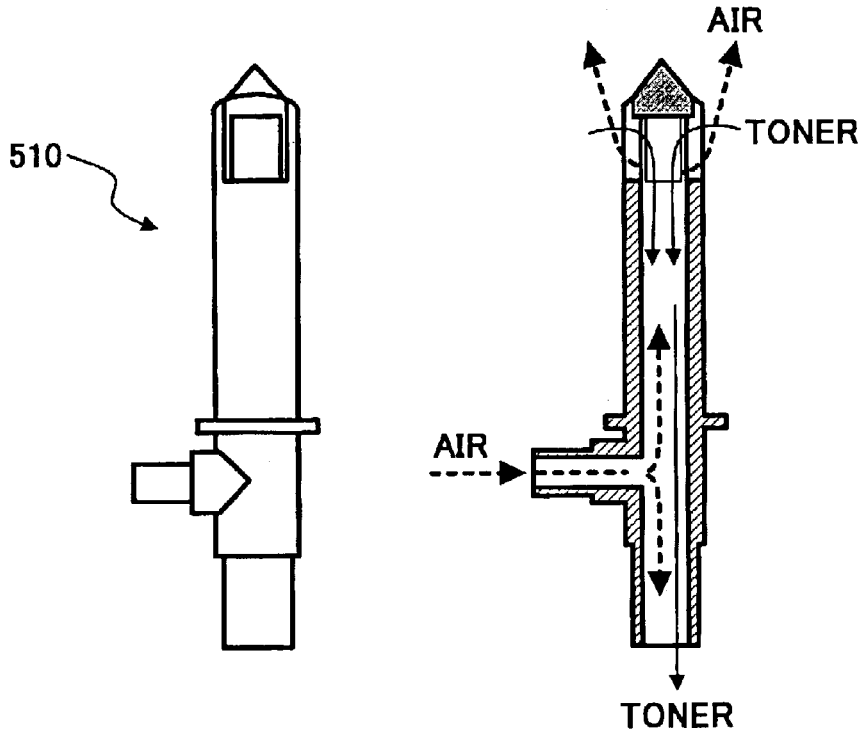
FIG. 15 is a schematic view of a nozzle in the toner conveying device of FIG. 13.
Figure 16:
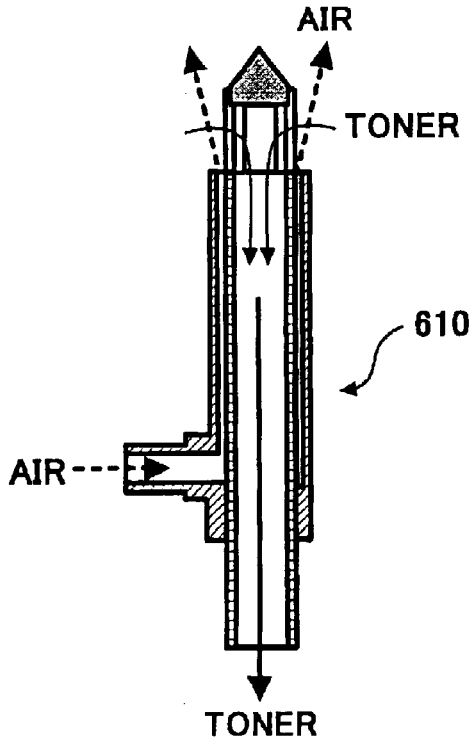
FIG. 16 is a schematic cross section of a nozzle according to an alternative example.

The nozzle 510 is disposed at the bottom portion of the toner accommodating bag 410 such that the nozzle 510 passes through the seal member 422. The nozzle 510 is integrally or detachably attached to the container holder 500. As illustrated in FIG. 15, an air supplying path is merged with a toner conveying path in the nozzle 510. Instead of the nozzle 510, a nozzle having an alternative construction may be used. For example, as illustrated in FIG. 16, a nozzle 610 has a double-tube structure including an air supplying path at an outer side and a toner conveying path at an inner side. The toner conveying device illustrated in FIG. 13 uses the nozzle 510 illustrated in FIG. 15 which is formed at a lower cost than the nozzle 610 illustrated in FIG. 16.

When attaching the toner container 400 to the copying machine via the tube 301 and the powder pump 304, the nozzle 510 is inserted into the seal member 422 of the base member 420 which constructs a toner discharging outlet of the toner container 400. The seal member 422 is made of an elastic member, such as, sponge and rubber, in which a cross-shaped slit is provided. When the nozzle 510 is inserted into the seal member 422 of the base member 420, the seal member 422 is brought into intimate contact with the nozzle 510, thereby preventing the leakage of toner from the toner container 400. Further, when the toner container 400 is detached from the container holder 500, the slit of the seal member 422 is closed due to its elasticity, thereby preventing the leakage of toner from the toner container 400. The length of the slit of the seal member 422 is substantially equal to or greater than the outer diameter of the nozzle 510 by about 3 mm. The seal member 422 and the case 421 are joined each other by a double-faced adhesive tape. The seal member 422 is formed from an elastic body such as a foaming sponge and a rubber material, and has the quality of resistance to toner, little air penetration, and superior strength for creep.

Figure 17:
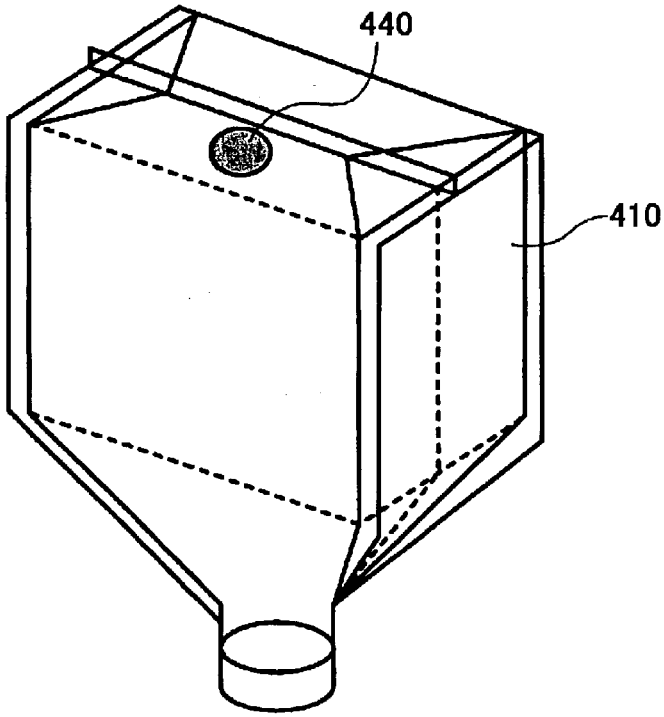
FIG. 17 is a perspective view of a toner accommodating bag of a toner container in the toner conveying device of FIG. 13.

As illustrated in FIG. 17, an airflow filter 440 may be provided at the top surface of the toner accommodating bag 410. With the provision of the airflow filter 440, excess air pressure in the toner accommodating bag 410 generated by the air supplied from the air supply device 600 can be prevented.

After all the toner in the toner container 400 is consumed, the toner container 400 is easily split into the protection case 401 and the toner accommodating bag 410. Because the protection case 401 is foldable and the toner accommodating bag 410 is flexible, as compared to background hard toner cartridge and bottle, the toner container 400 has advantages in compact size, handleability at the time of transportation and storage, and savings in storage space. Therefore, the distribution cost for collecting toner containers from a user to a manufacturer can be greatly reduced.

The toner conveying device according to another embodiment of the present invention supplies toner to the developing device 200 through the flexible tube 301. Therefore, the toner conveying device can be provided at any position in an image forming apparatus where a user can smoothly replace the toner container 400 with a new one. In this point, the above-described construction of the toner conveying device is especially advantageous in a multi-color image forming apparatus that includes multiple color toner conveying devices.

Figure 18:
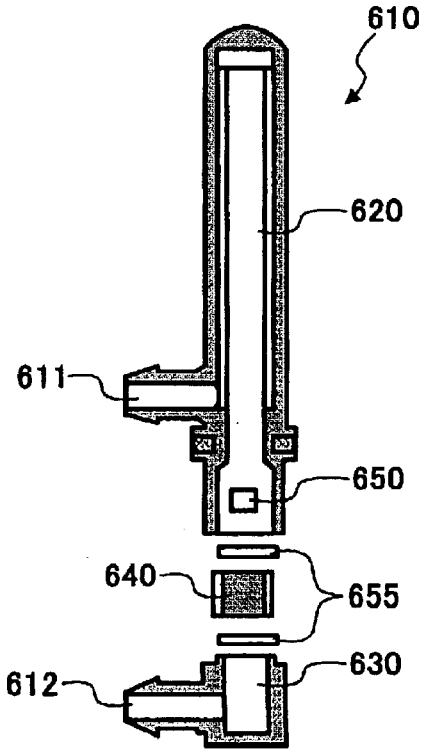
FIG. 18 is a cross sectional exploded view of the nozzle of FIG. 16.
Figure 19:
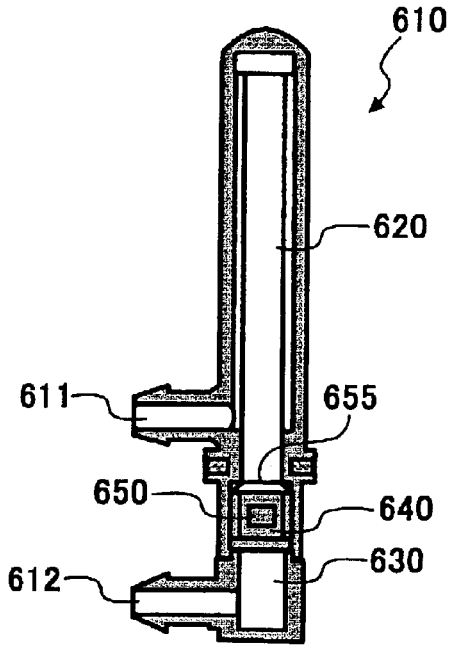
FIG. 19 is a cross section of the assembled nozzle of FIG. 18.
Figure 20:
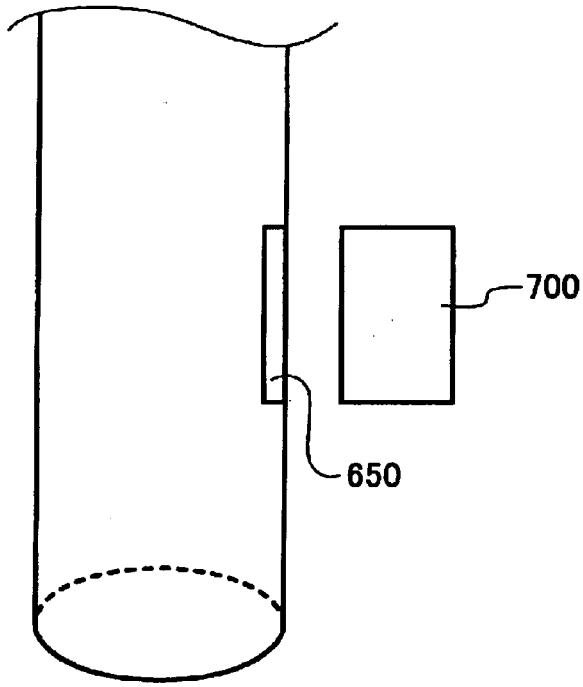
FIG. 20 is a schematic view of an optical sensor provided opposite to an opening of the nozzle of FIG. 19.

Referring to FIG. 18, the nozzle 610 having a double-tube structure is split into an upper nozzle 620 and a lower nozzle 630 between an air supply inlet 611 and a toner discharging outlet 612. Further, a window-shaped opening 650 is formed at the bottom part of the upper nozzle 620. A glass tube 640 is engaged with the inside part of the upper nozzle 620 at the position of the opening 650, and thereby the opening 650 is closed by the glass tube 640. If a space is formed at the junction part between the upper nozzle 620 and the glass tube 640, the leakage of toner from the nozzle 610 tends to occur. To avoid the leakage of toner, two O-rings 655 are disposed at both end parts of the glass tube 640, respectively. As illustrated in FIG. 19, the glass tube 640 is supported while being sandwiched between the upper nozzle 620 and the lower nozzle 630. Further, as illustrated in FIG. 20, an optical sensor 700 is provided opposite to the opening 650 to detect the amount of toner flowing in the toner conveying path in the glass tube 640. The toner supply control operation and airflow amount adjusting control operation described referring to FIGS. 9A, 9B, and 10 are similarly performed in this embodiment based on the detection result of the optical sensor 700. The detailed descriptions for a control device and control operations are omitted here. With the above-described toner supply control operation and airflow amount adjusting control operation, the optical sensor 700 also functions to detect whether the toner container 400 is running out of toner or not (i.e., a toner end condition in the toner container 400).

To supply toner smoothly from the toner container 400 to the developing device 200, it is necessary to transmit pressure smoothly from the powder pump 304 to the leading edge of the nozzle 610. To avoid the pressure loss caused by the big difference of the diameter of the toner conveying path, the respective inner diameters of the upper nozzle 620, the O-rings 655, the glass tube 640, and the L-shaped lower nozzle 630 are substantially equal to each other.

Further, by making the inner diameter of the toner conveying tube 301 substantially equal the above-described inner diameters, toner can be properly supplied from the toner container 400 to the developing device 200. As described above, the nozzle 610 has a double-tube structure including an air supplying path and a toner conveying path. With this structure, the air supplied from the air supply device 600 does not influence the toner flowing in the toner conveying path in the vicinity of the optical sensor 700. Therefore, the optical sensor 700 can accurately detect the amount of toner flowing in the toner conveying path.

In the nozzle 610, toner does not tend to adhere onto the surface of the glass tube 640, and the preferable condition of the surface of the glass tube 640 detected by the optical sensor 700 (hereafter referred to as a "detection surface") can be maintained for a long time without being cleaned by a cleaning member.

It is considered that the adhering of toner to a detection surface depends on a surface property such as surface roughness of the detection surface and electric resistivity of the material of the detection surface. When a detection surface is made of materials having low surface roughness and low electric resistivity, toner does not tend to adhere to the detection surface. Further, it is said that when the material of a detection surface is the same as that of toner, toner tends to adhere to the detection surface due to the attraction force between the detection surface and toner. As a material which satisfies the above-described conditions, glass can be used. Glass has an advantage in its high transparency.

For the above-described reasons, the surface of a toner conveying path in the nozzle 610 detected by the optical sensor 700 is made of glass which does not tend to be stained by toner. By use of the glass tube 640 and the optical sensor 700, the amount of toner passing in the toner conveying path in the glass tube 640 can be adequately detected in this embodiment.

In the above-described toner conveying devices illustrated in FIGS. 2 and 13 according to the embodiments of the present invention, a toner container (e.g., toner cartridge) is long in a vertical direction, and a nozzle disposed below the toner container in the vertical direction is easily filled with toner discharged from the toner container. With this construction, the toner discharged from the toner container smoothly flows in the nozzle without forming an air hole in the vicinity of a toner flow amount detecting device, so that the detection error of the detecting device can be prevented. Further, because the surface of a toner conveying path in the nozzle detected by the toner flow amount detecting device is positioned in the vertical direction, toner does not tend to adhere to the detection surface. In the embodiments, the toner flow amount detecting device can adequately detect the amount of toner flowing in a toner conveying path in the nozzle without cleaning the detection surface by a cleaning member.

The present invention is applied to a copying machine that forms a toner image by use of a two-component developer including toner and magnetic carrier. Alternatively, the present invention can be applied to a copying machine that forms a toner image by use of a one-component developer containing only toner (i.e., without magnetic carrier).

In the above-described embodiments, the present invention is applied to a toner conveying device that conveys toner from a toner container to a developing device. However, the present invention can be applied to a powder conveying device that conveys any type of powder, for example, magnetic carrier, and a two-component developer.

Further, in the above embodiments, the light writing unit 11 uses a laser system. However, an LED system may be also used.

Moreover, the present invention can be also applied to an image forming apparatus that forms images by a direct recording method instead of an electrophotographic method.

The present invention is applied to a single-color copying machine. Alternatively, the present invention can be applied to a multi-color copying machine.

Further, the present invention can be applied not only to a copying machine, but also to similar image forming apparatuses such as a printer, a facsimile machine, etc. or a multifunctional image forming apparatus.

Numerous additional modifications and variations of the present invention are possible in light of the above teachings. It is therefore to be understood that within the scope of the appended claims, the present invention may be practiced otherwise than as specifically described herein.

What is claimed:

1. A toner conveying device, comprising:

a toner container configured to contain toner;

a toner discharge urging device configured to urge the discharge of the toner from the toner container;

a toner conveying mechanism configured to convey the toner discharged from the toner container through a toner conveying path member;

a flow amount detecting device configured to detect a flow amount of the toner conveyed in the toner conveying path member; and a nozzle configured to deliver air from the toner discharge urging device and configured to guide the toner from the toner container through the toner conveying path member, the flow amount detecting device surrounding a portion of the nozzle.

2. The toner conveying device according to claim 1, wherein the flow amount detecting device includes an optical sensor.

3. The toner conveying device according to claim 2, wherein the toner conveying mechanism includes a powder pump configured to suck the toner from the toner container through the toner conveying path member, wherein the nozzle includes a glass part formed from glass materials, wherein the optical sensor is provided opposite to the glass part to detect the flow amount of the toner at the glass part of the nozzle, and wherein a toner end condition in the toner container is detected based on the detection result of the optical sensor.

4. The toner conveying device according to claim 1, wherein the toner discharge urging device urges the discharge of the toner from the toner container by supplying air into the toner container.

5. The toner conveying device according to claim 1, wherein the toner conveying mechanism conveys the toner while sucking the toner in the toner conveying path member.

6. A toner conveying device comprising:

a toner container configured to contain toner;

a toner discharge urging device configured to urge the discharge of the toner from the toner container;

a toner conveying mechanism configured to convey the toner discharged from the toner container through a toner conveying path member; and a flow amount detecting device configured to detect a flow amount of the toner conveyed in the toner conveying path member, wherein the flow amount detecting device includes an optical sensor, wherein the toner conveying mechanism includes a powder pump configured to suck the toner from the toner container through the toner conveying path member, wherein the toner conveying path member includes a glass part formed from glass materials, wherein the optical sensor is provided opposite to the glass part to detect the flow amount of the toner at the glass part of the toner conveying path member, and wherein a toner end condition in the toner container is detected based on the detection result of the optical sensor, and wherein a nozzle is disposed in the toner conveying path member, wherein the nozzle is inserted into the toner container such that the nozzle is directed upward through a bottom part of the toner container, and wherein the glass part is disposed in the nozzle.

7. The toner conveying device according to claim 6, wherein the glass part of the nozzle is formed from a glass tube, and the optical sensor is provided opposite to the glass tube to detect the flow amount of the toner in the glass tube.

8. The toner conveying device according to claim 6, wherein the nozzle has a double-tube structure including a toner conveying path, and an air supplying path through which air is supplied into the toner container.

9. The toner conveying device according to claim 8, wherein the nozzle having the double-tube structure includes an upper nozzle, an O-ring, the glass tube, and a lower nozzle.

10. The toner conveying device according to claim 9, wherein an inner diameter of the toner conveying path is substantially equal to an inner diameter of the glass tube.

11. The toner conveying device according to claim 8, wherein an inner diameter of the nozzle having the double-tube structure is substantially equal to an inner diameter of the toner conveying path member.

12. An image forming apparatus, comprising:

a latent image carrier configured to carry a latent image;

a developing device configured to develop the latent image with toner to form a toner image;

a toner conveying device that conveys toner to the developing device, including, a toner container configured to contain toner;

a toner discharge urging device configured to urge the discharge of the toner from the toner container;

a toner conveying mechanism configured to convey the toner discharged from the toner container through a toner conveying path member; and a flow amount detecting device configured to detect a flow amount of the toner conveyed in the toner conveying path member;

a control device configured to control the toner discharge urging device to drive according to the detection result of the flow amount detecting device; and a nozzle configured to deliver air from the toner discharge urging device and configured to guide the toner from the toner container through the toner conveying path member, the flow amount detecting device surrounding portion of the nozzle.

13. The image forming apparatus according to claim 12, wherein the flow amount detecting device includes an optical sensor.

14. The image forming apparatus according to claim 13, wherein the toner conveying mechanism includes a powder pump configured to suck the toner from the toner container through the toner conveying path member, wherein the nozzle includes a glass part formed from glass materials, wherein the optical sensor is provided opposite to the glass part to detect the flow amount of the toner at the glass part of the nozzle, and wherein a toner end condition in the toner container is detected based on the detection result of the optical sensor.

15. The image forming apparatus according to claim 12, wherein the toner discharge urging device urges the discharge of the toner from the toner container by supplying air into the toner container.

16. The image forming apparatus according to claim 12, wherein the toner conveying mechanism conveys the toner while sucking the toner in the toner conveying path member.

17. An image forming apparatus comprising:

a latent image carrier configured to carry a latent image;

a developing device configured to develop the latent image with toner to form a toner image;

a toner conveying device that conveys toner to the developing device, including, a toner container configured to contain toner;

a toner discharge urging device configured to urge the discharge of the toner from the toner container;

a toner conveying mechanism configured to convey the toner discharged from the toner container through a toner conveying path member; and a flow amount detecting device configured to detect a flow amount of the toner conveyed in the toner conveying path member; and a control device configured to control the toner discharge urging device to drive according to the detection result of the flow amount detecting device, wherein the flow amount detecting device includes an optical sensor, wherein the toner conveying mechanism includes a powder pump configured to suck the toner from the toner container through the toner conveying path member, wherein the toner conveying path member includes a glass part formed from glass materials, wherein the optical sensor is provided opposite to the glass part to detect the flow amount of the toner at the glass part of the toner conveying path member, and wherein a toner end condition in the toner container is detected based on the detection result of the optical sensor, and wherein a nozzle is disposed in the toner conveying path member, wherein the nozzle is inserted into the toner container such that the nozzle is directed upward through a bottom part of the toner container, and wherein the glass part is disposed in the nozzle.

18. The image forming apparatus according to claim 17, wherein the glass part of the nozzle is formed from a glass tube, and the optical sensor is provided opposite to the glass tube to detect the flow amount of the toner in the glass tube.

19. The image forming apparatus according to claim 17, wherein the nozzle has a double-tube structure including a toner conveying path, and an air supplying path through which air is supplied into the toner container.

20. The image forming apparatus according to claim 19, wherein the nozzle having the double-tube structure includes an upper nozzle, an O-ring, the glass tube, and a lower nozzle.

21. The image forming apparatus according to claim 20, wherein an inner diameter of the toner conveying path is substantially equal to an inner diameter of the glass tube.

22. The image forming apparatus according to claim 19, wherein an inner diameter of the nozzle having the double-tube structure is substantially equal to an inner diameter of the toner conveying path member.

23. An image forming apparatus, comprising:

latent image carrying means for carrying a latent image;

developing means for developing the latent image with toner to form a toner image;

first toner conveying means for conveying toner to the developing means, including, toner containing means for containing toner;

toner discharge urging means for urging the discharge of the toner from the toner containing means;

second toner conveying means for conveying the toner discharged from the toner containing means through a toner conveying path member; and flow amount detecting means for detecting the flow amount of the toner conveyed in the toner conveying path member;

control means for controlling the toner discharge urging means to drive according to the detection result of the flow amount detecting means; and nozzle means for delivering air from the toner discharge urging means and for guiding the toner from the toner containing means through the toner conveying path member, the flow amount detecting means surrounding a portion of the nozzle means.

* * * * *